US006065319A

United States Patent [19]

Mikami et al.

[11] Patent Number: 6,065,319

[45] Date of Patent: May 23, 2000

[54] ROLLING MILL WITH LATERALLY DIFFERENT VELOCITIES

[75] Inventors: Masao Mikami, Fujisawa; Masahiro Kuchi, Chigasaki; Sadahiko Shinya, Kanagawa-ken; Takayuki Iwasaki; Takashi Nishii, both of Yokohama, all of Japan

[73] Assignee: Ishikawajima-Harima Jukogyo Kabushiki Kaisha, Tokyo-to, Japan

[21] Appl. No.: 08/923,086

[22] Filed: Sep. 4, 1997

[30] Foreign Application Priority Data

| | | | |
|---|---|---|---|
| Sep. 11, 1996 | [JP] | Japan | 8-240463 |
| Mar. 6, 1997 | [JP] | Japan | 9-051827 |
| Mar. 26, 1997 | [JP] | Japan | 9-073403 |
| Jul. 24, 1997 | [JP] | Japan | 9-198801 |

[51] Int. Cl.[7] ..... B21B 39/20

[52] U.S. Cl. ..... 72/252.5

[58] Field of Search ..... 72/241.2, 241.4, 72/241.6, 241.8, 242.2, 242.4, 243.2, 243.4, 252.5, 232, 245, 247, 365.2, 366.2; 492/1, 16

[56] References Cited

U.S. PATENT DOCUMENTS

| | | | |
|---|---|---|---|
| 4,843,855 | 7/1989 | Kuwano et al. | 72/232 |

FOREIGN PATENT DOCUMENTS

| | | | |
|---|---|---|---|
| 109506 | 7/1982 | Japan | 72/241.2 |
| 59-10843 | 3/1984 | Japan . | |
| 3-34407 | 5/1991 | Japan . | |
| 4-178205 | 6/1992 | Japan | 72/241.6 |
| 40-5285503 | 11/1993 | Japan | 72/243.6 |
| 1435333-A1 | 11/1988 | U.S.S.R. | 72/252.5 |

*Primary Examiner*—Joseph J. Hail, III
*Assistant Examiner*—Rodney Butler
*Attorney, Agent, or Firm*—Oblon, Spivak, McClelland, Maier & Neustadt, P.C.

[57] ABSTRACT

Each of a pair of rolls has a barrel with different diameters axially of the barrel such that sum of the diameters of the barrels is substantially constant and that each of the rolls is bilaterally symmetrical. The rolls themselves have an ability to control workpiece profile and have at least one substantially parallel center portion.

13 Claims, 17 Drawing Sheets

FIG. 24
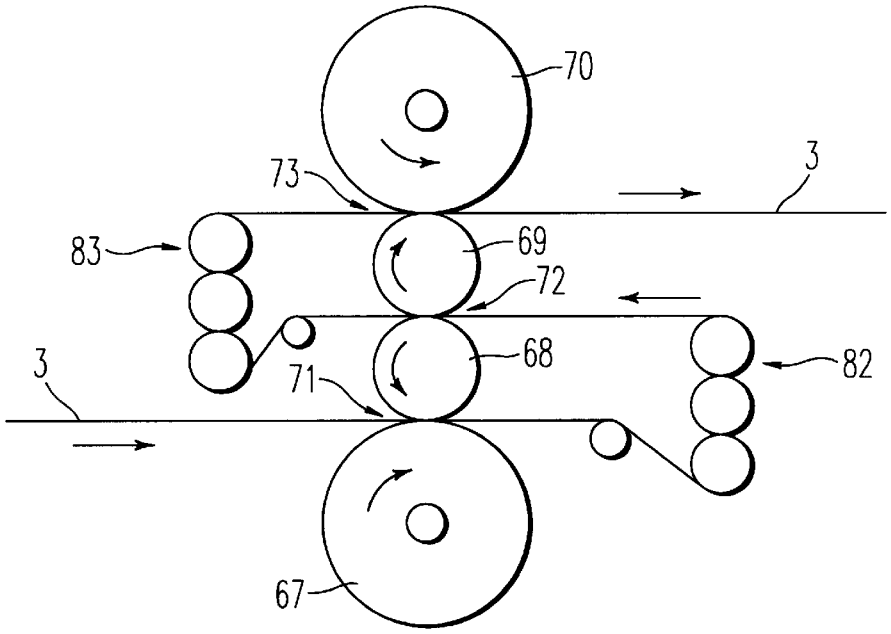
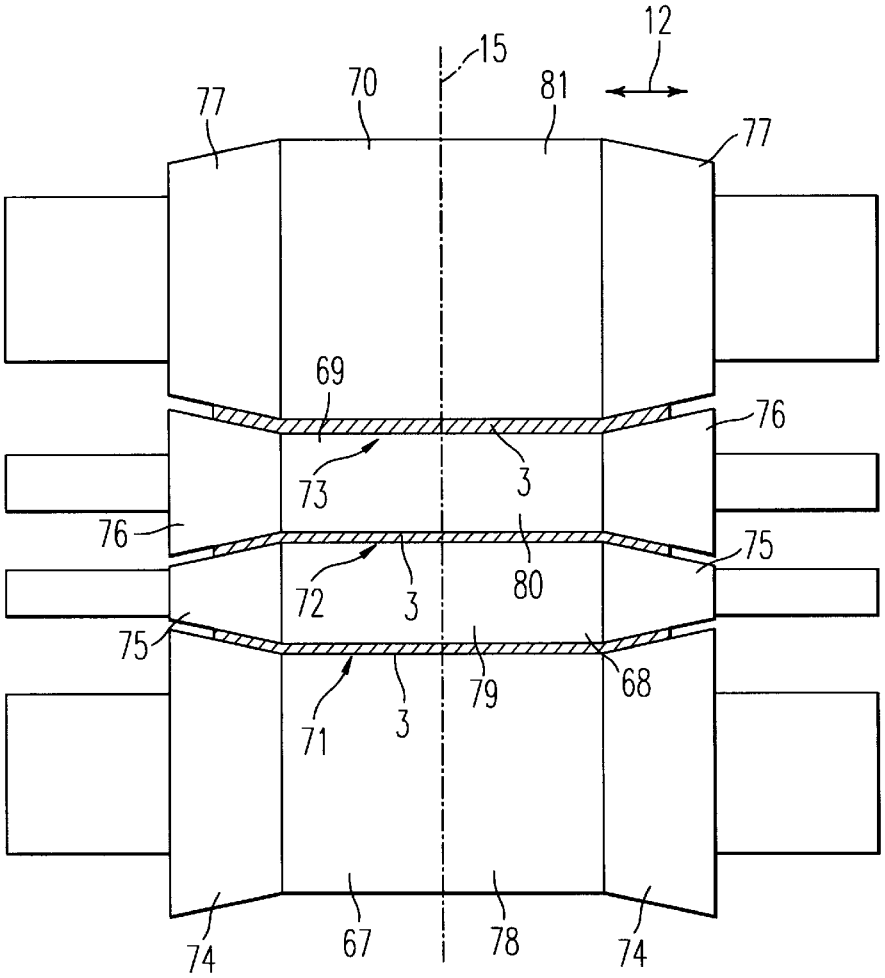
FIG. 25

ROLLING MILL WITH LATERALLY DIFFERENT VELOCITIES

BACKGROUND OF THE INVENTION

1. Field of the Invention

The present invention relates to a rolling mill with laterally different velocities.

2. Discussion of Background

In general, metal workpiece is rolled by passing it between a pair of upper and lower rolls in a rolling mill.

It is known in the art that in rolling operation, to rotate a pair of upper and lower rolls 1 and 2 at different rotational or peripheral velocities as shown in FIG. 28 will cause oppositely directed frictional shearing forces to act on upper and lower surfaces of the workpiece 3 which is being rolled through a roll gap 4. As a result, as compared with a rolling operation with the rolls 1 and 2 rotated at equal velocity, the same rolling draft can be attained with a lower rolling load or a higher rolling draft can be attained with the same rolling load. This is called different peripheral velocity rolling or different velocity rolling and has been widely practiced.

In the different velocity rolling as described above, the greater the difference between peripheral velocities of the rolls 1 and 2 is or the higher the different velocity ratio is, the smaller rolling load is required.

In the different velocity rolling as described above, so-called parallel rolls each having a barrel with axially uniform diameter have been used as said paired rolls 1 and 2, which have no ability of controlling workpiece profile for the purpose of correcting defective profile such as edge, center or quarter buckle. This necessitates some extra means being provided to achieve profile control of the workpiece 3.

SUMMARY OF THE INVENTION

The present invention was made in view of the above and as its object to provide a rolling mill with laterally different velocities which can apply rolling force on a workpiece with laterally different or uneven distribution and can readily adjust the distribution pattern during rolling operation, thereby substantially reducing the occurrence of edge drop and crown on a rolled product in comparison with conventional different velocity rolling mills.

The present invention provides a rolling mill with laterally different velocities which comprises a pair of rolls each having a barrel with different diameters axially of the barrel such that sum of the diameters of the barrels is substantially constant and that each of the rolls is bilaterally symmetrical, rotational velocity ratio of the rolls being changeable.

This makes the diameter ratio of the roll barrels to have axially different or uneven distribution. Therefore, when the rolls are rotated to roll a workpiece, the peripheral velocity ratio of the barrels has axially different or uneven distribution so that a rolling force with different or uneven distribution axially of the rolls can be applied to the workpiece.

Distribution pattern of the rolling force axially of the rolls is readily adjustable during rolling operation by changing the rotational velocity ratio of the rolls. The occurrence of edge drop or crown on a rolled product can be reduced by adjusting the distribution pattern of the rolling force such that the rolling force is relatively increased at and near the opposite lateral edges of the workpiece or is relatively decreased at and near the lateral center of the workpiece.

More specifically, generally, increased rolling force will increase elastic concave deformation of the roll, resulting in increase of the roll gap and thus increase in thickness of the workpiece. Decreased rolling force will decrease elastic concave deformation of the roll, resulting in a decrease of the roll gap and thus a decrease in the thickness of the workpiece. Accordingly, when the rolling force is relatively increased at and near the lateral edges of the workpiece, the occurrence of edge drop can be decreased. When the rolling force is relatively decreased at and near the lateral center of the workpiece, occurrence of crown can be reduced.

In actual rolling operations, however, there may be various situations which occur. Occurrence of edge drop may be more serious than that of crown. Occurrence of crown may be more serious than that of edge drop. Profile control of workpiece may be desired in addition to prevention of crown or edge drop. Anyway, consideration must be also given to change of roll over time since the roll may be thermally expanded in diameter at and near its axial center with lapse of time after the starting of rolling operation. Therefore, of course, the distribution pattern of the rolling force must be adjusted in accordance with each individual case and roll change.

According to the invention, even if the rotational velocity ratio of the rolls is 1.0 (i.e., the same rotational velocity), the effect of decreasing the rolling force can be expected owing to different velocity rolling based on different or uneven distribution of roll diameter ratio of the rolls. Change of the rotational velocity ratio of the rolls into any value other than 1.0 will further enhance the effect of decreasing the rolling force, so that the level of the rolling force necessary for carrying out the rolling operation with the same rolling draft can be decreased as a whole. Such enhanced effect of decreasing the rolling force will enhance the effect of reducing occurrence of edge drop or crown.

The different diameters of the roll barrels axially of them according to the invention may be provided such that the barrel of one of the rolls has largest diameter at its axial roll center and is convergent or gradually decreased in diameter toward opposite ends of said one roll and that the barrel of the other roll has the smallest diameter at its axial roll center and is divergent or gradually increased in diameter toward opposite ends of said other roll.

Each of the rolls may have a parallel roll portion uniform in diameter at and near its axial roll center and may be supported at the very parallel roll portion by a backup roll.

This enables rolling operation with the rolls being supported at their parallel portions by the backup rolls. As a result, the rolls can be made smaller in size to reduce the level of the rolling force necessary for carrying out rolling operation with same rolling draft.

In the case where each of the rolls has the parallel roll portion at and near the axial roll center, one of the rolls may have increased-diameter or divergent portions outwardly of its parallel portion toward the opposite ends of the one roll, the other roll having decreased-diameter or convergent portions outwardly of its parallel portion toward the opposite ends of the other roll. Each of the outwardly divergent and convergent portions contiguous with the central parallel portions of the barrels may additionally end with a further parallel portion at the corresponding roll end.

Further, the paired rolls may be contoured to have minute gaps between them at which the rolls are not mutually contacted upon application of light load and are mutually contacted upon application of rolling load.

When a light load for zeroing is applied to the rolls, these minute gaps will prevent the barrel portions having peripheral velocity difference due to diameter difference from being mutually contacted, thereby preventing occurrence of any vibration and/or seizure due to zeroing.

On the contrary, when a heavy load such as rated rolling load is applied, any influence of the minute gaps on the barrel portions having peripheral velocity difference due to diameter difference is negligible because of the heavy load being applied, so that rolling operation can be carried out with no trouble.

The present invention further provides a rolling mill with laterally different velocities which comprises a pair of rolls each having a barrel with axial, varied profile portions such that sum of the diameters of the barrels is substantially constant and that each of the rolls is bilaterally symmetrical with respect to axial roll center of the roll, at least one of the rolls being in the form of a profile variable roll whose counter may be partially varied during rolling operation.

In this case, the profile variable roll may be a variable crown roll whose counter may be partially varied by selectively supply and discharging pressure fluid to and from fluid pressure chambers in the roll.

Alternatively, the profile variable roll may be a tapered piston roll whose counter may be partially varied by displacing tapered pistons inside the roll.

The varied profile portions of the roll barrel may be provided with fluid pressure chambers or tapered pistons for partial profile variation of the profile variable roll.

The varied profile portions may be provided by mutually compensationally divergent and convergent portions of the rolls.

In a case where both the rolls are in the form of profile variable rolls, a control unit may be provided to make one of the rolls partly divergent and make the other roll partly convergent correspondingly.

As described above, for rolling operation, a pair of rolls are used each of which has a barrel with axial, varied profile portions, the barrel being bilaterally symmetrical with respect to the axial roll center, the sum of roll diameters of the barrels being substantially constant. This makes the peripheral velocity of the rolls axially different or uneven, so that laterally different velocity rolling can be made and laterally different rolling force can be applied, which contributes to providing the profile control ability.

The controlled profile amount can be adjusted by providing at least one of said paired rolls in the form of a profile variable roll to partially change the profile during rolling operation.

As the profile variable roll, a variable crown roll may be used whose profile can be partially changed by selectively supplying and discharging pressure fluid to and from fluid pressure chambers inside the roll.

Alternatively, as the profile variable roll, a tapered piston roll may be used whose profile can be partially changed by displacing tapered pistons inside the roll.

It is more effective to provide the varied profile portion with fluid pressure chambers or tapered pistons in order to partially change the profile of the varied profile portions.

The varied profile portions of the rolls may be provided by mutually compensational divergent and convergent portions of the rolls.

In a case where both the rolls are in the form of profile variable rolls, a control unit may be provided to make one and the other of the rolls partly divergent and convergent mutually compensationally.

Further, the invention provides a rolling mill with laterally different velocities which comprises at least three rolls combined in pairs to form a plurality of rolling passes, the paired adjacent rolls each having a barrel which is bilaterally symmetrical with respect to axial roll center of the roll, the sum of roll diameters of the barrels of the paired rolls being substantially constant, the barrels of one and the other of said paired rolls having mutually compensatory varied profile portions.

In this case, the workpiece is passed sequentially through the rolling passes between the paired rolls from upstream to undergo laterally different velocity rolling a plurality of times.

Such multi-pass rolling on the single rolling mill will allow the laterally different velocity rolling per rolling pass to be smaller in extent. As a result, the degree of profile variation of the varied profile portion can be decreased to prevent problems such as streaking and bending of the workpiece on boundaries between the varied profile portions.

Because of multi-pass rolling, even when the extent of profile variation of the varied profile portions for each rolling pass is decreased, a greater effect of different velocity rolling can be attained as a whole in comparison with a case of single pass rolling on a single rolling mill; and rolling operation with higher rolling draft can be readily achieved.

Preferred embodiments of the present invention will be described in conjunction with attached drawings.

BRIEF DESCRIPTION OF THE DRAWINGS

FIG. 24 is a schematic side view of a ninth embodiment of the invention;

FIG. 25 is a front view of the embodiment shown in FIG. 24;

DESCRIPTION OF THE PREFERRED EMBODIMENTS

Figure 1:
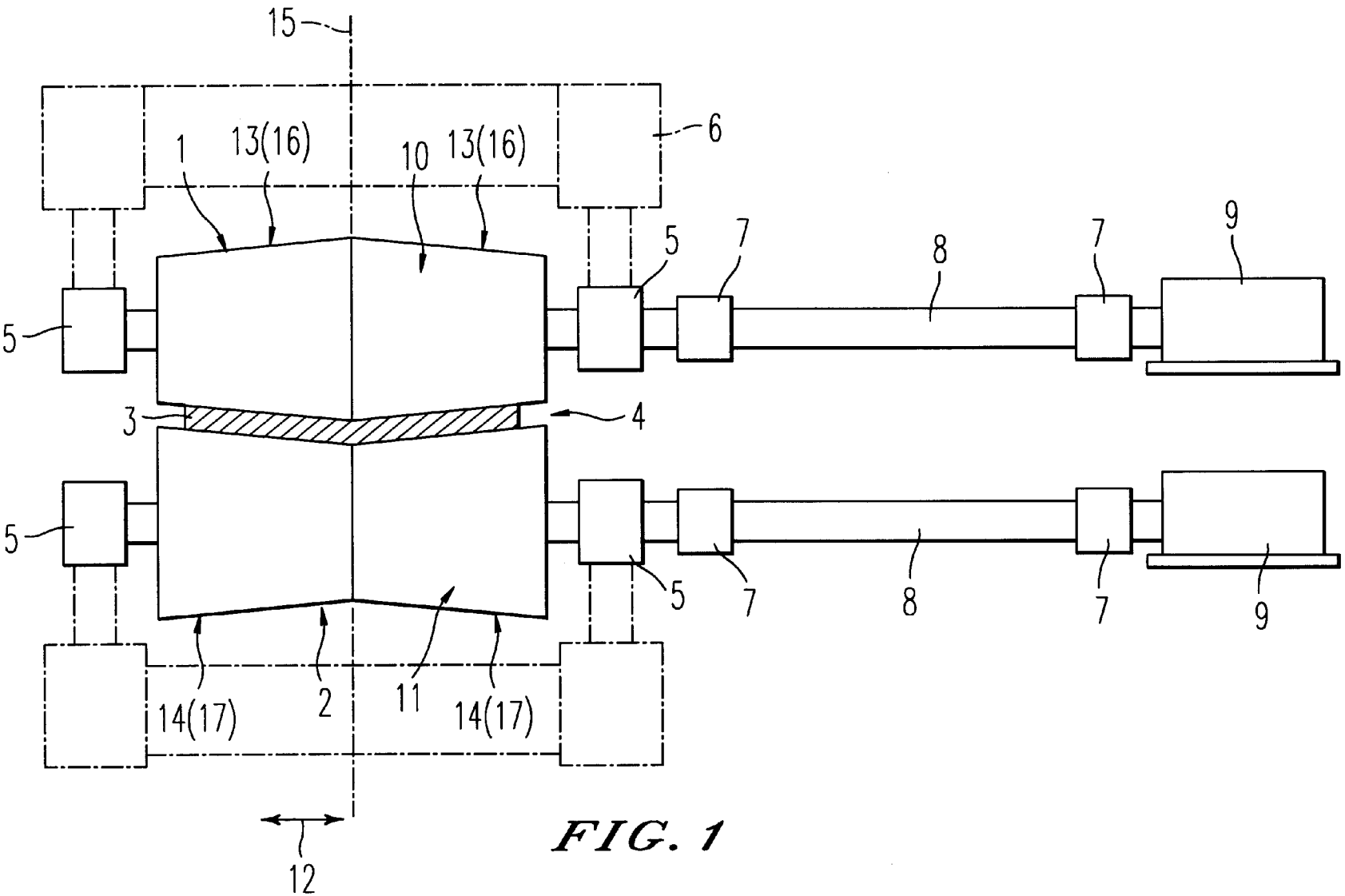
FIG. 1 schematically illustrates a first embodiment of the present invention.

FIGS. 1 to 6 represent a first embodiment of a rolling mill with laterally different velocities according to the invention. As shown in FIG. 1, a pair of upper and lower rolls 1 and 2 for rolling a workpiece 3 are rotatably supported at their ends by roll chocks 5 in a housing 6. Each of the rolls 1 and 2 is connected at one end thereof (i.e., the right end in FIG. 1) through universal couplings 7 and a spindle 8 to a separate rotating drive 9 so that rotational velocity ratio of the rolls 1 and 2 may be changed as desired.

Figure 2:
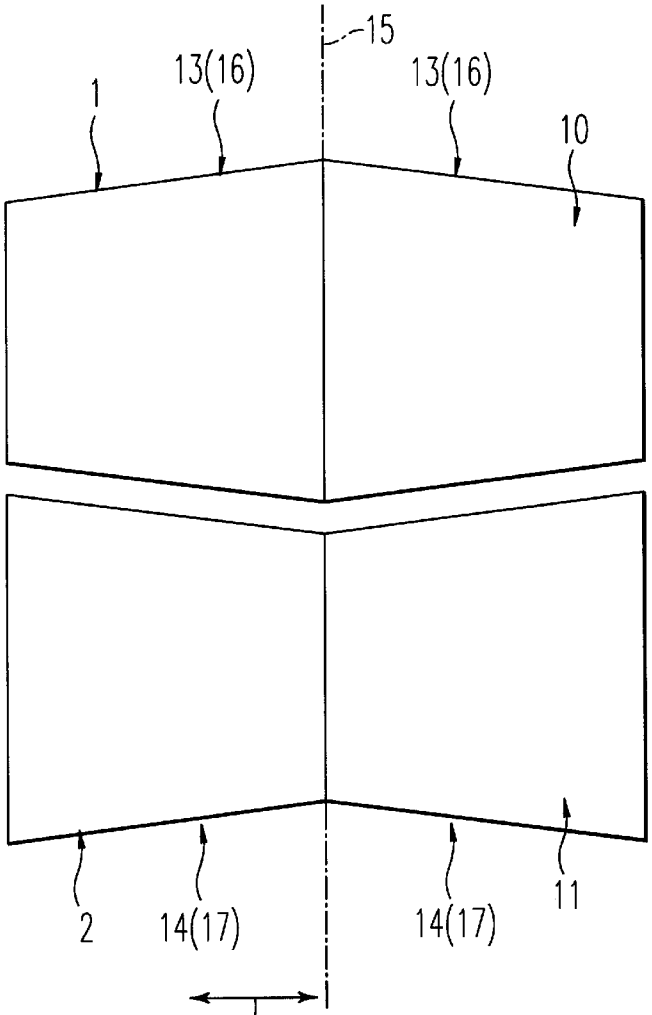
FIG. 2 is an enlarged view of barrels of the rolls shown in FIG. 1.

As shown or an enlarged scale in FIG. 2, barrels 10 and 11 of the rolls 1 and 2 respectively comprise varied profile portions 13 and 14 with different diameters in axial direction 12 of the rolls such that the sums of roll diameters of the portions 13 and 14 of the barrels 10 and 11 are substantially constant and that each of the rolls 1 and 2 is bilaterally symmetrical. Particularly, in this embodiment, the barrel 10 comprises outwardly convergent portions 16 each of which has largest diameter at axial roll center 15 and is gradually decreased in diameter toward a corresponding roll end; and the barrel 11 comprises outwardly divergent portions 17 each of which has smallest diameter at the roll center 15 and is gradually increased in diameter toward a corresponding roll end.

Next, operation of this embodiment will be described.

Figure 3:
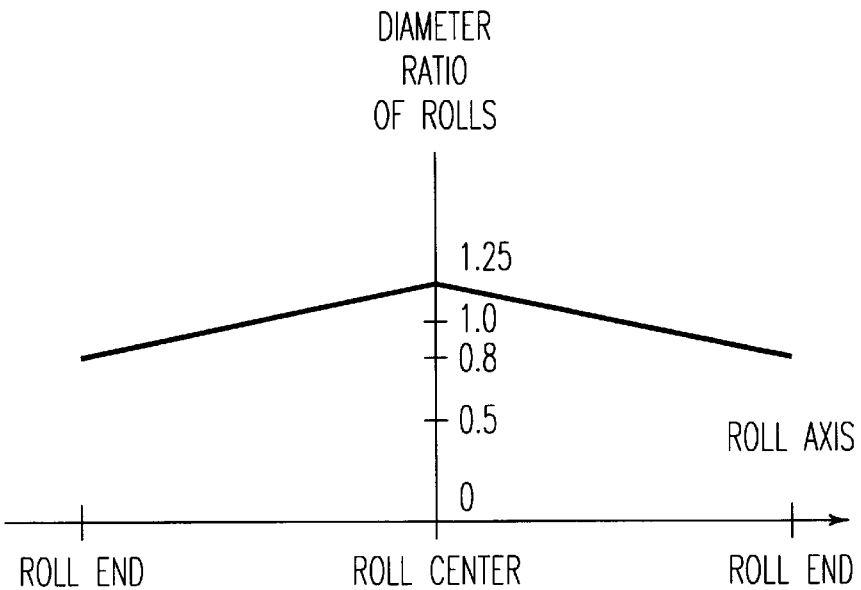
FIG. 3 is a diagram showing distribution of roll diameter ratio of the barrels shown in FIG. 2.

With the above arrangement, the barrels 10 and 11 have axially different or uneven distribution of roll diameter ratio as shown in FIG. 3.

Figure 4:
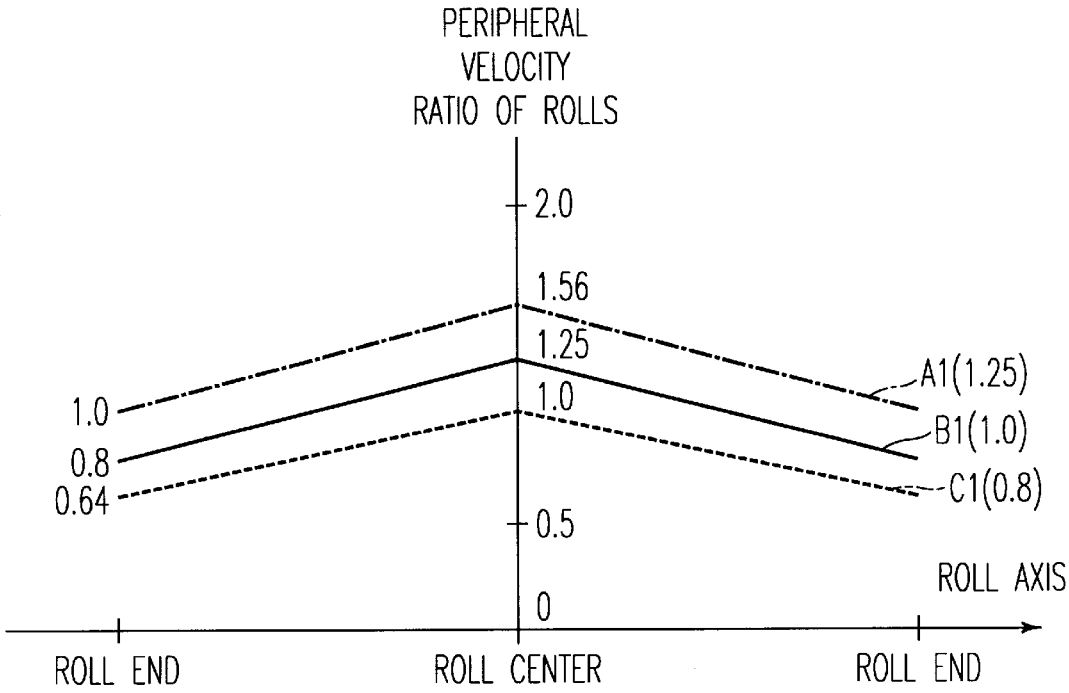
FIG. 4 is a diagram showing the distribution of roll peripheral velocity ratio of the barrels shown in FIG. 2.

Rotation of the rolls 1 and 2 in the above arrangement will cause the peripheral velocity ratio of the barrels 10 and 11 of the rolls 1 and 2 to have different or uneven distribution in the axial direction 12. More specifically, as shown in FIG. 4, with rotational velocity ratios of the rolls 1 and 2 (i.e. ratios of rotational velocity of the upper roll 1 to rotational velocity of the lower roll 2) being 1.25, 1.0 and 0.8, the results are as shown by A1, B1 and C1, respectively.

Further, when peripheral velocities of the upper and lower rolls 1 and 2 at axial positions are supposed to be $V_1$ and $V_2$, respectively, different velocity rate X is obtained as follows:

$$\text{when } V_1/V_2 \geqq 1,\ X = V_1/V_2 - 1.0 \quad (1)$$

and $$\text{when } V_1/V_2 < 1,\ X = V_2/V_1 1.0 \quad (2)$$

Figure 5:
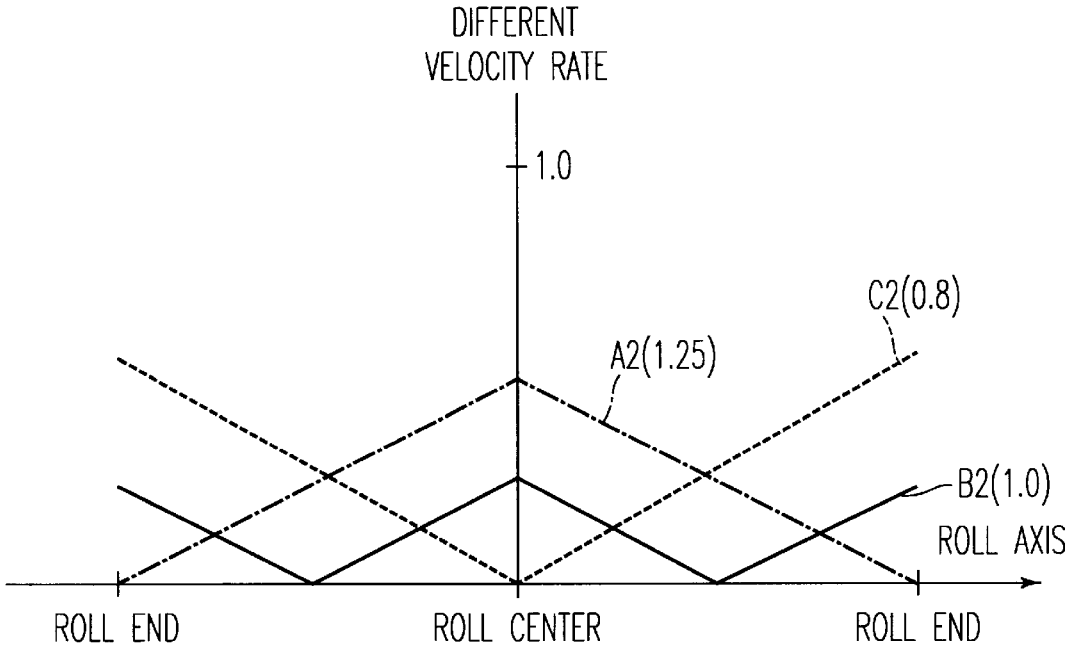
FIG. 5 is a diagram showing the distribution of different velocity rate in relation to the distribution of peripheral velocity ratio shown in FIG. 4.

When the different velocity rate X is calculated in relation to the distribution of the peripheral velocity ratio shown in FIG. 4, the results are as shown by A2, B2 and C2 as shown in FIG. 5 with respect to the rotational velocity ratios of the rolls 1 and 2 being 1.25, 1.0 and 0.8, respectively.

Figure 6:
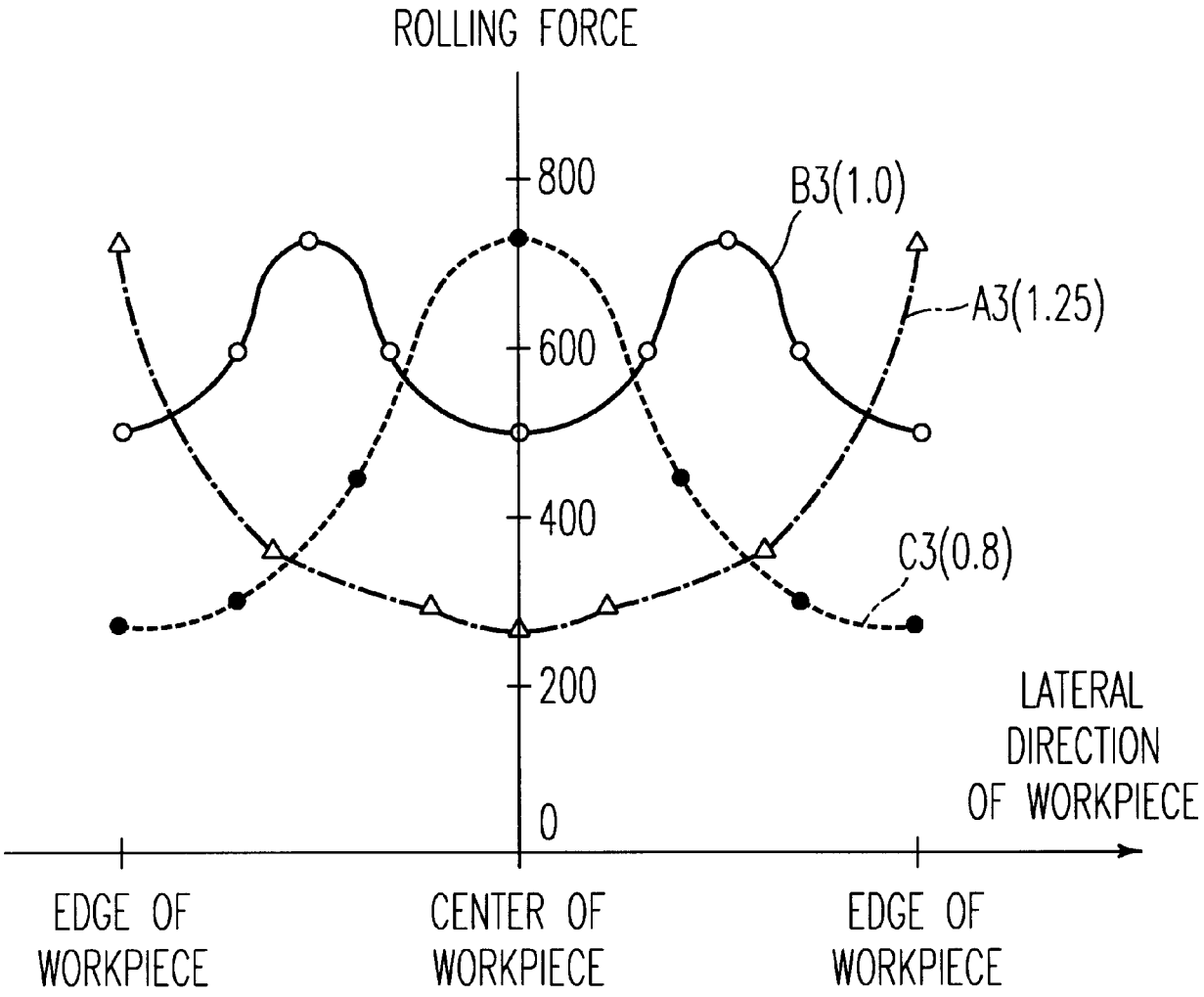
FIG. 6 is a diagram showing the distribution of rolling force in relation to the different velocity rate shown in FIG. 5.

This distribution pattern of the different velocity rate X is closely related with the distribution pattern of rolling force laterally of the workpiece 3 (i.e., axially of the rolls 1 and 2). There is a tendency such that, when the different velocity rate X is high, the rolling force is decreased, and when the different velocity rate X is low, the rolling force is increased. As shown in FIG. 6, the distribution pattern of rolling force laterally of the workpiece 3 is as shown by A3, B3 and C3 with the rotational velocity ratios of the rolls 1 and 2 being 1.25, 1.0 and 0.8, respectively.

Therefore, according to this embodiment, the rolling force can be applied with different or uneven distribution in the axial direction 12 of the rolls 1 and 2 when the workpiece 3 is rolled between the rolls. Moreover, distribution pattern of the rolling force can be readily changed laterally of the workpiece 3 during rolling operation by changing the rotational velocity ratio of the rolls 1 and 2.

Thus, the distribution pattern of the rolling force may be adjusted by the rotational velocity ratio of the rolls such that, as shown by A3 in FIG. 6, the rolling force is relatively increased at and near the lateral edges of the workpiece 3 (i.e., at and near the ends of the rolls 1 and 2) and is relatively decreased at and near the lateral center of the workpiece 3 (i.e., at and near the axial roll center 15 of the rolls 1 and 2), which can reduce the occurrence of edge drop and crown.

More specifically, in general, where a higher rolling force is applied laterally of the workpiece 3, elastic concave deformation of the rolls 1 and 2 increases and the thickness of the workpiece 3 is increased as the roll gap 4 is increased. Where the lower rolling force is applied laterally of the workpiece 3, elastic concave deformation on the rolls 1 and 2 decreases and the thickness of the workpiece 3 is decreased as the roll gap 4 is reduced. Therefore, edge drop is reduced by relatively increasing the rolling force at and near the lateral edges of the workpiece 3; and, crown is reduced by relatively decreasing the rolling force at and near the lateral center of the workpiece 3.

In actual rolling operations, however, there may be various cases. Occurrence of edge drop may be more serious than that of crown. Occurrence of crown may be more serious than that of edge drop. Profile control of workpiece 3 may be desired in addition to prevention of crown or edge drop. Anyway, consideration must be also given to change of roll over time since the roll may be thermally expanded in diameter at and near its axial center 15 with lapse of time after the starting of rolling operation. Therefore, of course, the distribution pattern of the rolling force must be adjusted in accordance with each individual case and roll change. The distribution pattern of the rolling force shown by A3 in FIG. 6 is not necessarily optimal.

Thus, the distribution pattern of the rolling force shown by B3 in FIG. 6 is effective in a case where the workpiece 3 is locally thinner in terms of thickness at an intermediate position between the lateral center and the edge of the workpiece and has poorer flatness and defective profile. The distribution pattern of the rolling force shown by C3 in FIG.

6 is effective to a case where each of the rolls 1 and 2 has an increased diameter at on near the roll center 15 due to thermal expansion. To adjust the distribution pattern of the rolling force, to such an extent as not to impair the effect of reducing any edge drop or crown, by changing the rotational velocity ratio of the rolls is meaningful as countermeasure for defective profiles of the workpiece and thermal deformation of the rolls 1 and 2.

According to the invention, even if the rotational velocity ratio of the rolls 1 and 2 is set to 1.0 (i.e., the same rotational velocity), the effect of reducing the rolling force can be expected owing to different velocity rolling based on the different or uneven distribution of roll diameter ratio of the rolls. Change of the rotational velocity ratio of the rolls into any value other than 1.0 will further enhance the effect of decreasing the rolling force, so that the rolling force necessary for carrying out the rolling operation with the same rolling draft can be decreased as a whole. Such enhanced effect of decreasing the rolling force will enhance the effect of reducing occurrence of edge drop or crown.

FIGS. 7 to 12 represent a second embodiment of the invention in which the barrels 10 and 11 of the rolls 1 and 2 have parallel portions 18 and 19 at or near the roll center 15 which have no change in diameter or no profile change and at which the rolls 1 and 2 are supported by backup rolls 20 and 21, respectively. Particularly in this embodiment, as shown in the enlarged view in FIG. 8, divergent portions 22 each having diameter gradually increased toward the corresponding roll end are provided outwardly of the parallel portion 18 of the barrel 10 of the upper roll 1; and convergent portions 23 each having diameter gradually reduced toward the corresponding roll end are provided outwardly of the parallel portion 19 of the barrel 10 of the lower roll 2.

In this arrangement, rolling can be performed with the rolls 1 and 2 being supported at their parallel portions 18 and 19 at or near the roll center 15 by the backup rolls 20 and 21, respectively. Therefore, the level of the rolling force necessary for rolling with the same rolling reduction can be further decreased by decreasing each of the rolls 1 and 2 in size.

Figure 7:
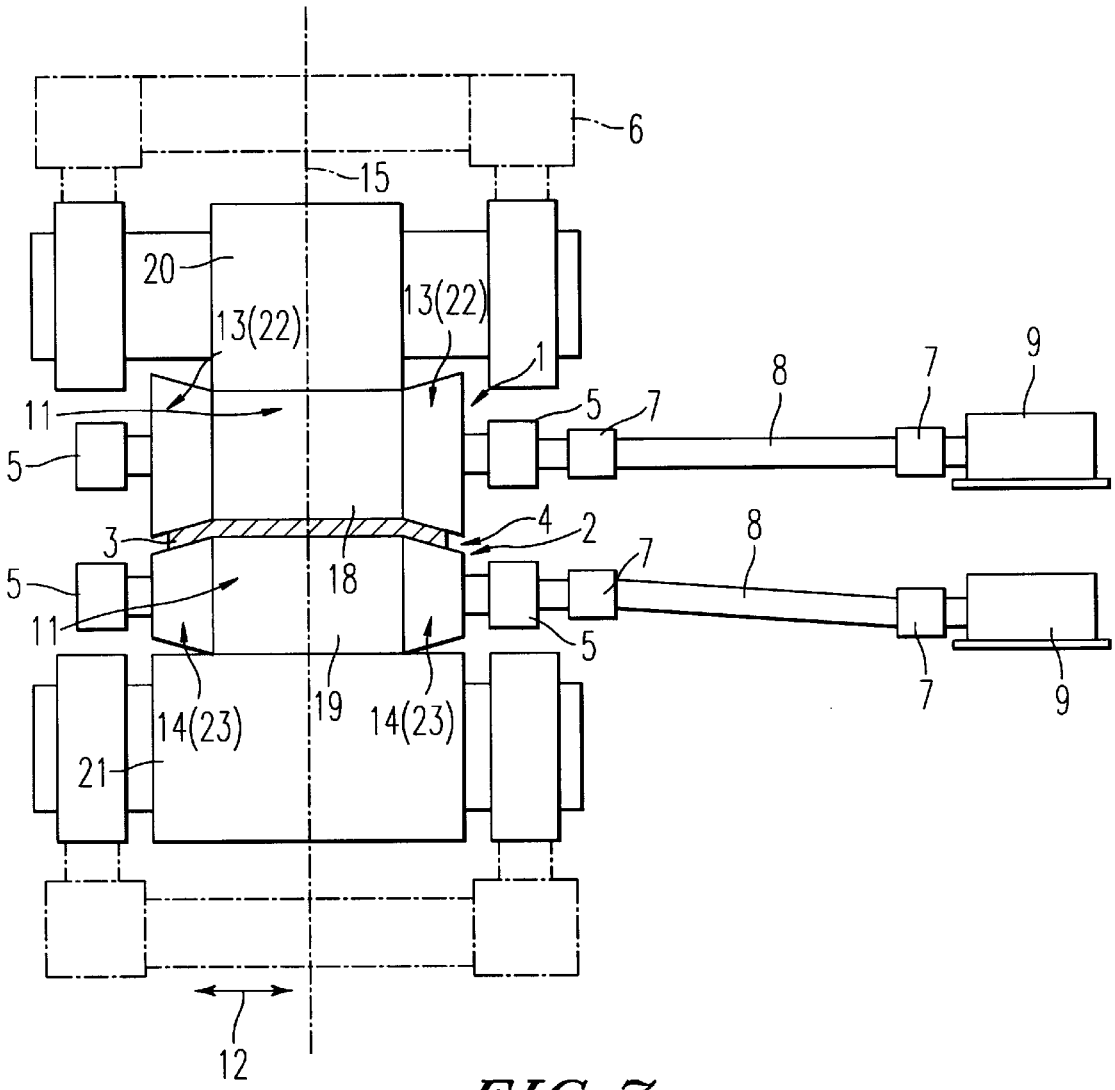
FIG. 7 schematically illustrates a second embodiment of the present invention.

In FIG. 7, for facilitating an understanding of the profile of the rolls 1 and 2, the diameters of the rolls 1 and 2 are shown in an exaggerated manner with respect to diameters of the backup rolls 20 and 21. In fact, the sizes of the rolls 1 and 2 can be reduced than they are conjectured from the figure.

Figure 9:
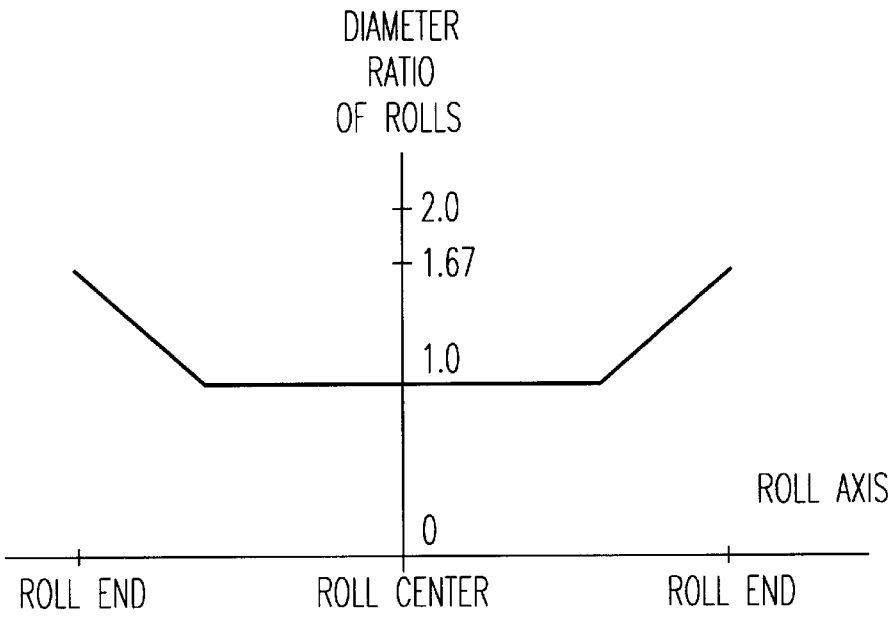
FIG. 9 is a diagram showing the distribution of roll diameter ratio of the barrels shown in FIG. 8.

This embodiment has distribution of the roll diameter ratio as shown in FIG. 9. When the rolls 1 and 2 are rotated, the peripheral velocity ratio on the barrels 10 and 11 of the rolls 1 and 2 has an uneven distribution axially of the rolls. More specifically, as shown in FIG. 10, with the rotational velocity ratio of the rolls 1 and 2 being 1.2, 1.0, 0.8 and 0.6, the results are as shown by A1, B1, C1 and D1, respectively.

Figure 10:
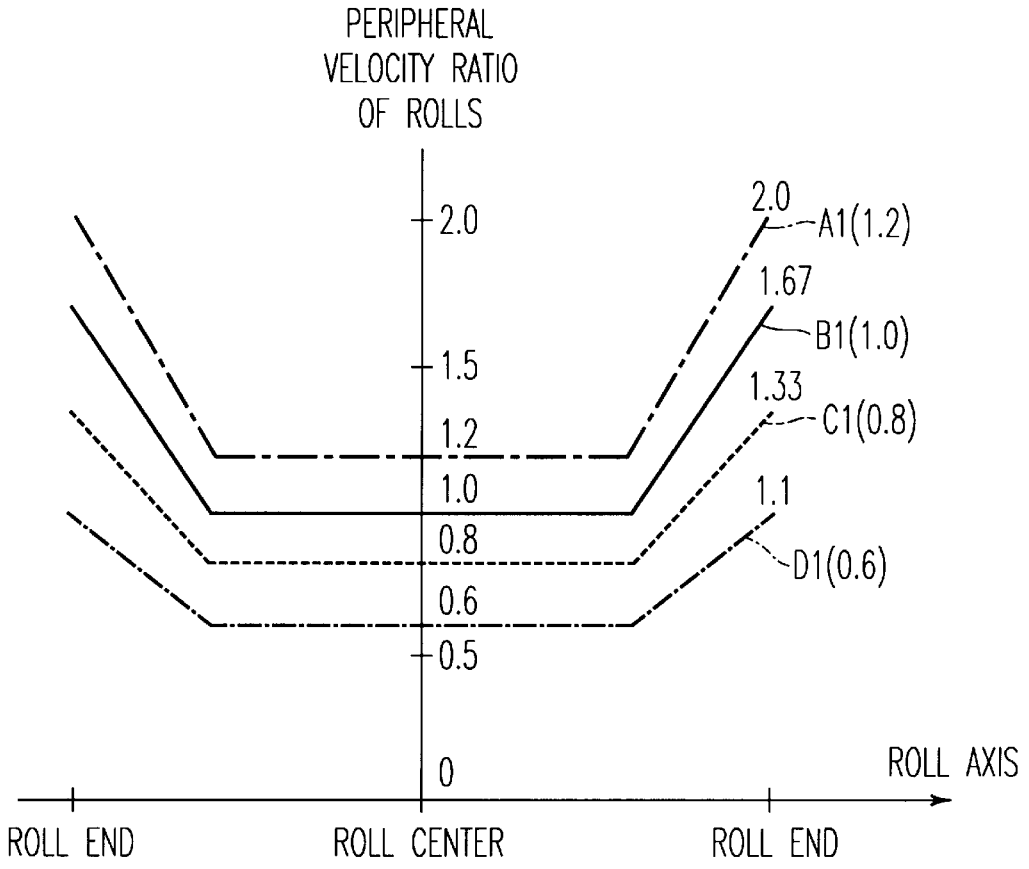
FIG. 10 is a diagram showing the distribution of roll peripheral velocity ratio of the barrels shown in FIG. 8.
Figure 11:
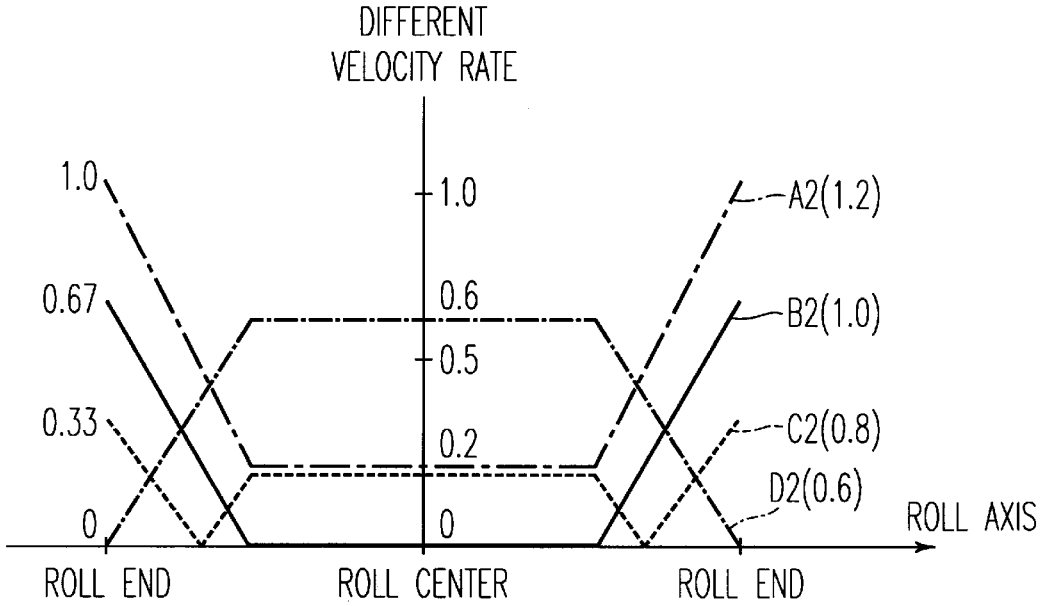
FIG. 11 is a diagram showing the distribution of different velocity rate in relation to the distribution of peripheral velocity ratio shown in FIG. 10.

Further, when different velocity rate X is calculated on the distribution of the peripheral velocity ratio shown in FIG. 10, the results are as shown by A2, B2, C2 and D2 in FIG. 11 with the rotational velocity ratio of the rolls 1 and 2 being 1.2, 1.0, 0.8 and 0.6, respectively.

Figure 12:
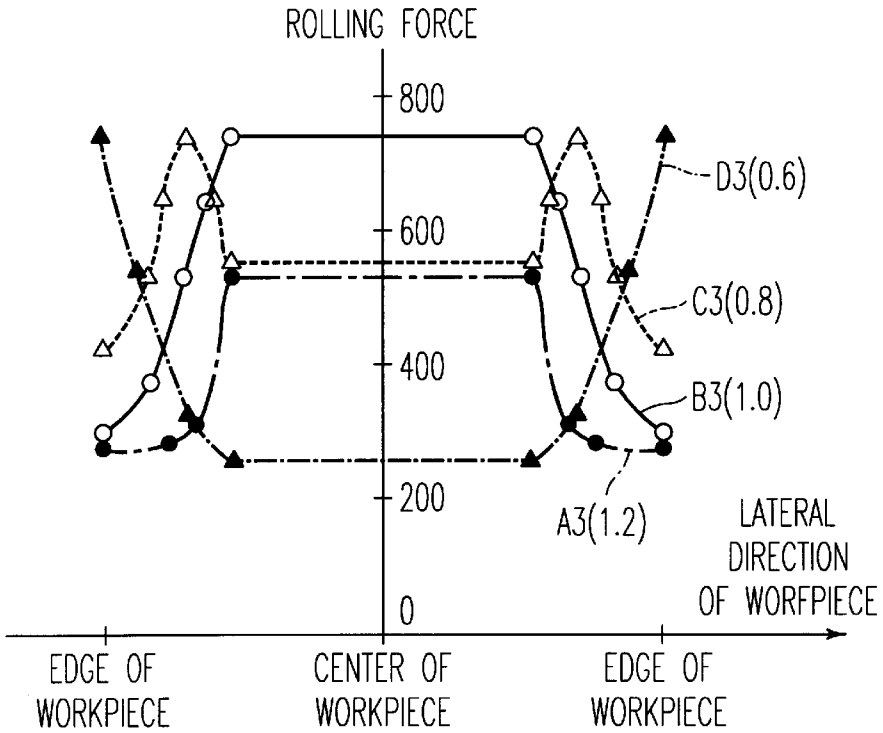
FIG. 12 is a diagram showing the distribution of rolling force in relation to the distribution of different velocity rate shown in FIG. 11.

As shown in FIG. 12, as to the distribution pattern of the rolling force laterally of the workpiece 3, the results are as given by A3, B3, C3, and D3 with rotational velocity ratio of the rolls 1 and 2 being 1.2, 1.0, 0.8 and 0.6, respectively.

FIGS. 13 to 17 represents a third embodiment of the present invention in which further parallel portions 24 and 25 are provided at and near the roll ends of the rolls 1 and 2 in the embodiment shown in FIG. 7 as described above. More specifically, divergent portions 22 each having a diameter gradually increased toward the corresponding roll end are provided outwardly of the parallel portion 18 of the barrel 10 of the upper roll 1 and end with further parallel portions 24 each having no change in diameter at and near the corresponding roll end. Also, convergent portions 23 each having a diameter gradually decreased toward the corresponding roll end are provided outwardly of the parallel portion 19 of the barrel 11 of the lower roll 2 and end with further parallel portions 25 each having no change in diameter at and near the corresponding roll end.

Figure 14:
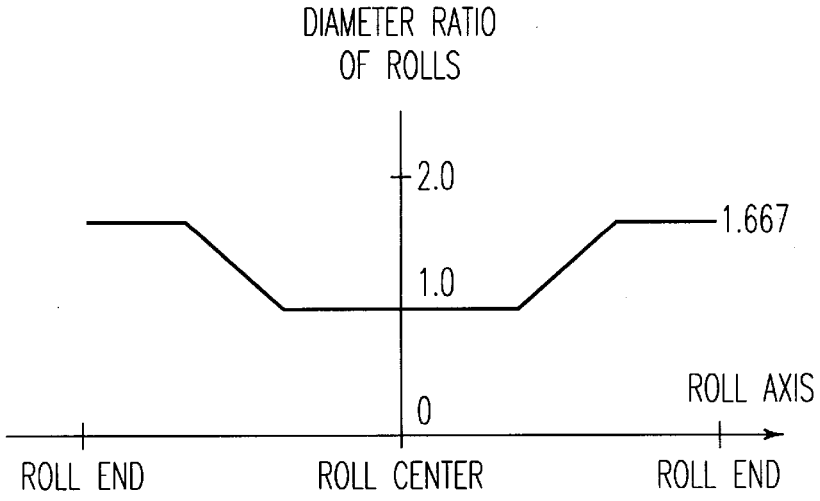
FIG. 14 is a diagram showing the distribution of roll diameter ratio of the barrels shown in FIG. 13.

This embodiment has a distribution of roll diameter ratio as shown in FIG. 14. When the rolls 1 and 2 are rotated, the peripheral velocity ratio on the barrels 10 and 11 of the rolls 1 and 2 shows different or uneven distribution axially of the rolls. More specifically, the results are as shown by A1, B1, C1 or D1 in FIG. 15 with the rotational velocity ratio of the rolls 1 and 2 being 1.2, 1.0, 0.8 and 0.6, respectively.

Figure 15:
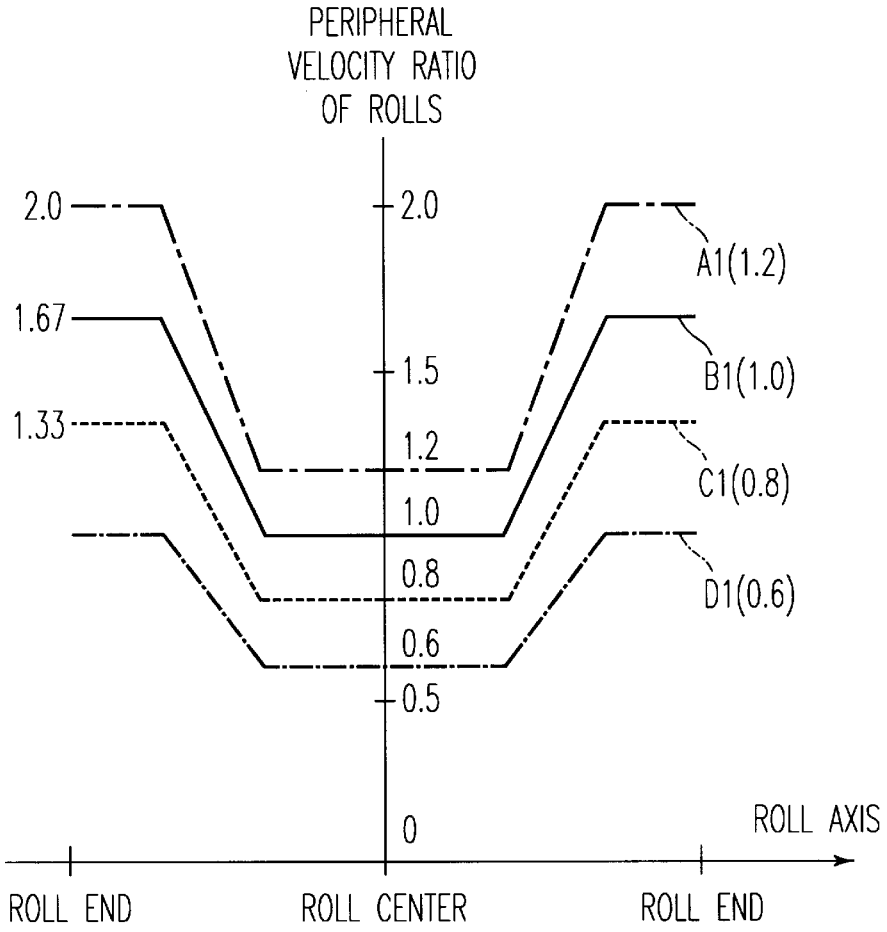
FIG. 15 is a diagram showing the distribution of roll peripheral velocity ratio of the barrels shown in FIG. 13.
Figure 16:
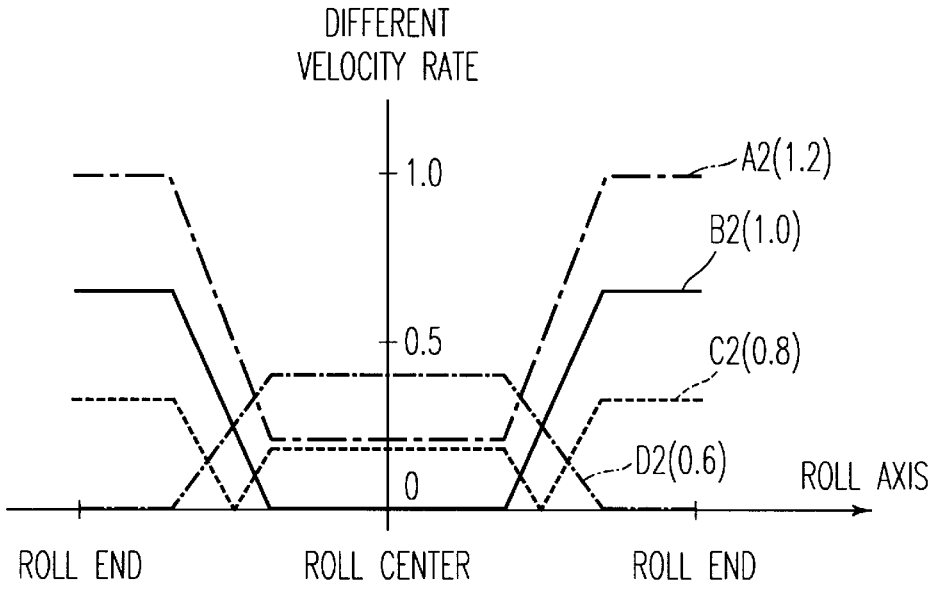
FIG. 16 is a diagram showing the distribution of different velocity rate in relation to the distribution of peripheral velocity ratio shown in FIG. 15.

Further, when the different velocity rate X is calculated with regard to the distribution of the peripheral velocity ratio in FIG. 15, the results are as shown by A2, B2, C2 and D2 in FIG. 16 with the rotational velocity ratio of the rolls 1 and 2 being 1.2, 1.0, 0.8 and 0.6, respectively.

Figure 17:
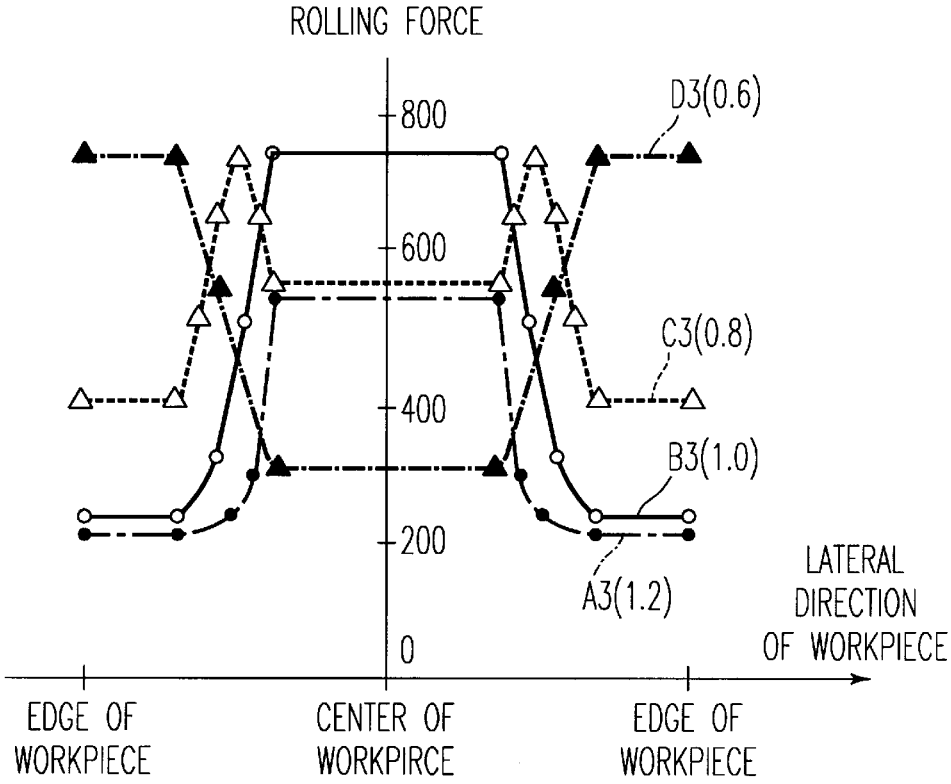
FIG. 17 is a diagram showing the distribution of rolling force in relation to the different velocity rate shown in FIG. 16.

Then, distribution pattern of the rolling force laterally of the workpiece 3 is as shown In FIG. 17. The results are as shown by A3, B3, C3 and D3 with the rotational velocity ratio of the rolls 1 and 2 being 1.2, 1.0, 0.8 and 0.6, respectively.

In the above-noted discussion, an explanation has been given for three typical embodiments of the invention. A difference in diameter is given to the barrels 10 and 11 of the paired rolls 1 and 2 to provide the varied profile portions 13 and 14 such that sum of roll diameters of the axially portions 13 and 14 of the barrels 10 and 11 is substantially constant and that each of the rolls 1 and 2 is bilaterally symmetrical, the rotational velocity ratio of the rolls 1 and 2 being changeable. With this arrangement, the rolling force applied on the workpiece 3 has different or uneven distribution axially of the rolls and the distribution pattern can be readily controlled during rolling operation by changing the rotational velocity ratio of the rolls 1 and 2. Accordingly, rolling operation can be performed with a distribution pattern of the rolling force suitable for reducing the occurrence of edge drop and crown. Moreover, change of the rotational velocity ratio of the rolls 1 and 2 into any value other than 1.0 will enhance the effect of reduce the rolling force in normal different velocity rolling, so that the level of the rolling force necessary for rolling operation can be decreased as a whole. This makes it possible to substantially reduce occurrence of edge drop or crown in comparison with conventional different velocity rolling mills.

Figure 18:
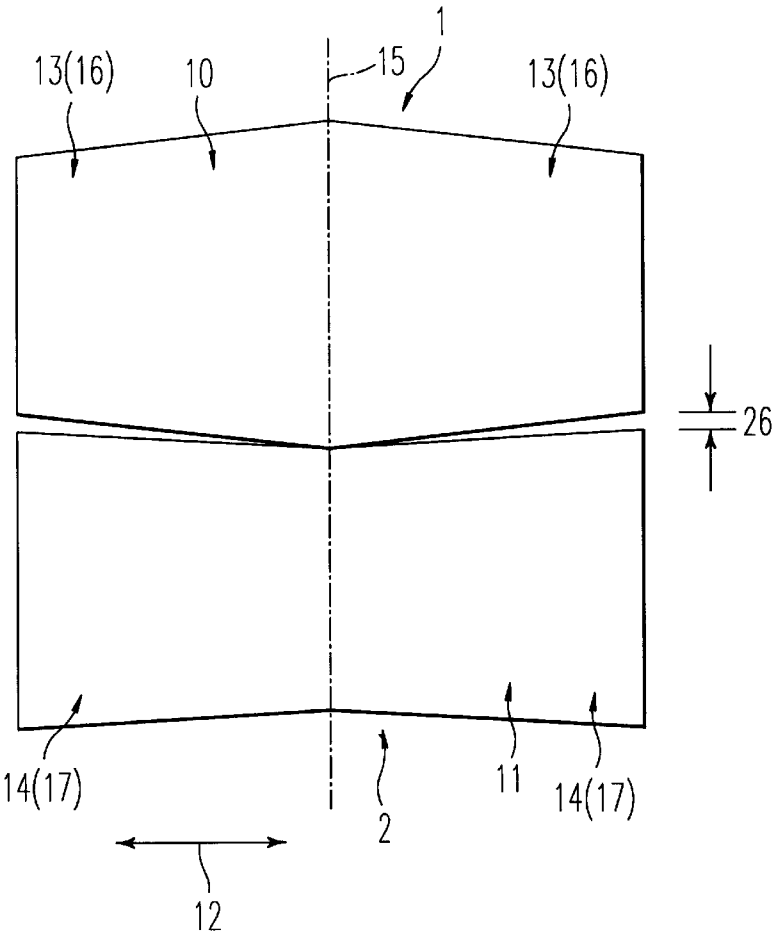
FIG. 18 schematically illustrates a fourth embodiment of the invention.

FIG. 18 shows a fourth embodiment of the invention which is a variation of the first embodiment described above.

In this embodiment, paired rolls 1 and 2 have barrels 10 and 11 contoured to have minute gaps 26 between the varied profile portions 13 and 14 of the barrels 10 and 11 at which the rolls 1 and 2 are not mutually contacted upon application of light load and are mutually contacted upon application of rolling load.

The minute gaps 26 are in the order of several millimeters or less and are within such range that sum of roll diameters of the barrels is substantially constant.

More specifically, the barrel 10 of the upper roll 1 in FIG. 18 comprises only convergent portions 16 each having diameter gradually reduced from the roll center 15 toward the corresponding roll end. Also, the barrel 11 of the lower roll 2 comprises only divergent portions 17 each having diameter gradually increased from the roll center 15 toward the corresponding roll end. Between the convergent and divergent portions 16 and 17, the minute gaps 16 are gradually enlarged from the roll center 15 toward the roll ends are formed.

Upon roll replacement, re-assembling or gauge adjustment of the rolling mill, a light load of about 1–10% of the rated rolling load is applied and the barrels 10 and 11 of the rolls 1 and 2 are rotated in contact condition (so-called kiss rolling) to adjust the roll gap 4. This is carried out so as to absorb any looseness or backlash of the rolling mill and roll chock 5 and is called zeroing or zero adjustment. With the invention having the roll barrels 10 and 11 rotated at different or uneven peripheral velocity distribution axially of the rolls, such zeroing or zero adjustment may cause contact sliding between the rolls 1 and 2 at their portions where peripheral velocity is different due to diameter difference. As a result, there is possibility that vibrations or seizures may occur on the rolling mill. However, since the minute gaps 16 gradually enlarged toward the roll ends are provided between the convergent and divergent portions 22 and 23, the minute gaps 16 prevent the barrel portions having peripheral velocity difference due to diameter difference from being mutually contacted when light load is applied for zeroing. This prevents vibration or seizure due to zeroing.

On the contrary, when heavy load such as the rated rolling load is applied, the influence of the minute gaps 26 is negligible on the barrel portions having peripheral velocity difference due to diameter difference. Therefore, rolling operation can be carried out with no problems.

This embodiment has the same arrangement as in the second embodiment except as indicated above and can attain the same operation and effects as those in the second embodiment.

Figure 19:
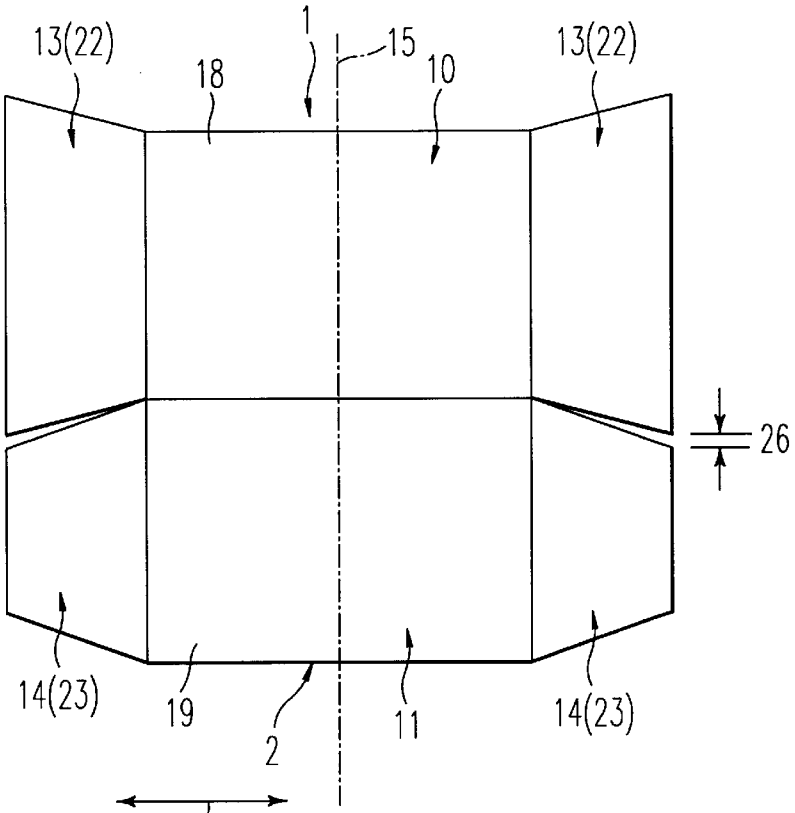
FIG. 19 schematically illustrates a fifth embodiment of the invention.

FIG. 19 shows a fifth embodiment of the invention which is a variation of the second embodiment described above.

In this embodiment, paired rolls 1 and 2 have barrels 10 and 11 contoured to have minute gaps 26 between the varied profile portions 13 and 14 of the barrels 10 and 11 at which the rolls 1 and 2 are not mutually contacted upon application of light load and are mutually contacted upon application of rolling load.

The minute gaps 26 are on the order of several millimeters or less and are within such range that the sum of the roll diameters of the barrels is substantially constant.

More specifically, the barrel 10 of the upper roll 1 in FIG. 19 comprises a parallel portion 18 at and near the roll center 15 and divergent portions 16 contiguous with the portion 18 and each having diameter gradually increased toward the corresponding roll end. Also, the barrel 11 of the lower roll 2 comprises a parallel portion 19 at and near the roll center 15 and having the same diameter as that of the parallel portion 18, and convergent portions 17 contiguous with the portion 19 and each having diameters gradually increased from the roll center 15 toward the corresponding roll end. Between the convergent and divergent portions 16 and 17, the minute gaps 16 gradually enlarged from the roll center 15 toward the roll ends are formed.

Upon roll replacement, re-assembling or gauge adjustment of the rolling mill, light load of about 1–10% of the rated rolling load is applied and the barrels 10 and 11 of the rolls 1 and 2 are rotated in contact condition (so-called kiss rolling) to adjust the roll gap 4. This is carried out so as to absorb any looseness or backlash of the rolling mill and roll chock 5 and is called zeroing or zero adjustment. With the invention having the roll barrels 10 and 11 rotated at different or uneven peripheral velocity distribution axially of the rolls, such zeroing or zero adjustment may cause contact sliding between the rolls 1 and 2 at their portions where peripheral velocity is different due to diameter difference. As a result, there is a possibility that vibrations or seizures may occur on the rolling mill. However, since the minute gaps 16 gradually enlarged toward the roll ends are provided between the convergent and divergent portions 22 and 23, the minute gaps 16 prevent the barrel portions having peripheral velocity difference due to diameter difference, from being mutually contacted when light load is applied for zeroing. This prevents vibration or seizure due to zeroing.

On the contrary, when a heavy load such as the rated rolling load is applied, the influence of the minute gaps 26 is negligible on the barrel portions having peripheral velocity difference due to diameter difference. Therefore, rolling operation can be carried out with no troubles.

This embodiment has the same arrangement as in the second embodiment except the above and can attain the same operation and effects as those in the second embodiment.

Figure 20:
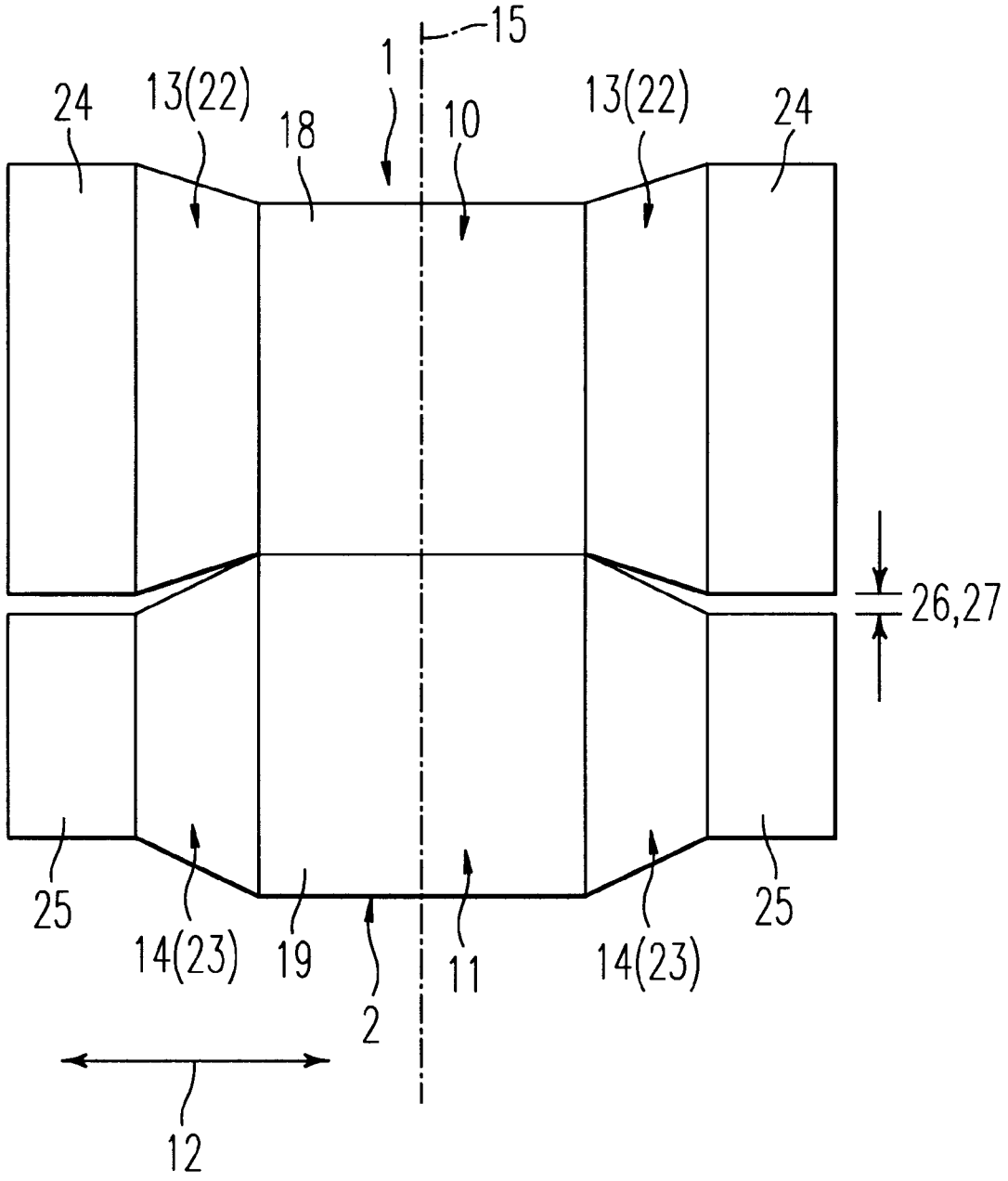
FIG. 20 schematically illustrates a sixth embodiment of the invention.

FIG. 20 shows a sixth embodiment of the invention which is a variation of the third embodiment as described above.

In this embodiment, paired rolls 1 and 2 have barrels 10 and 11 contoured so as to have minute gaps 26 between the varied profile portions 13 and 14 of the barrels 10 and 11 at which the rolls 1 and 2 are not mutually contacted upon application of light load and are mutually contacted upon application of rolling load.

The minute gaps 26 are in the order of several millimeters or less and are within such range that sum of roll diameters of the barrels is substantially constant.

More specifically, the barrel 10 of the upper roll 1 in FIG. 20 comprises a parallel portion 18 at and near the roll center 15 and divergent portions 22 contiguous with the parallel portion 18 and each having diameter gradually increased from the roll center 15 toward the corresponding roll end. The divergent portion 22 ends, at the corresponding roll end, with larger-diameter parallel portions 24. Also, the barrel 11 of the lower roll 2 comprises a parallel portion 19 at or near the roll center 15 and having the same diameter as that of the parallel portion 18 and convergent portions 23 contiguous with the parallel portion 19 and each having diameter gradually increased from the roll center 15 toward the corresponding roll end. The convergent portion 23 ends, at the corresponding roll end, with smaller-diameter parallel portions 25. Between the divergent and convergent portions 22 and 23, the minute gaps 26 gradually enlarged from the roll center 15 toward the roll ends are formed. Further, between the larger- and smaller-diameter parallel portions 24 and 25, minute gaps 27 are formed which are contiguous with the minute gaps 26 and have constant width.

Upon roll replacement, re-assembling or gauge adjustment of the rolling mill, light load of about 1–10% of the rated rolling load is applied and the barrels 10 and 11 of the rolls 1 and 2 are rotated in contact condition (so-called kiss rolling) to adjust the roll gap 4. This is carried out so as to absorb any looseness or backlash of the rolling mill and roll chock 5 and is called zeroing or zero adjustment. With the invention having the roll barrels 10 and 11 rotated at different or uneven peripheral velocity distributions axially of the rolls, such zeroing or zero adjustment may cause contact sliding between the rolls 1 and 2 at their portions where peripheral velocity is different due to diameter difference; as a result, there is possibility that vibrations or seizures may occur on the rolling mill. However, since the minute gaps 26 gradually enlarged toward the roll ends are provided between the divergent and convergent portions 22 and 23 and the minute gaps 27 having constant width are provided between the larger- and smaller-diameter parallel portions 24 and 25, the minute gaps 26 and 27 prevent the barrel portions having peripheral velocity difference due to diameter difference from being mutually contacted when light load is applied for zeroing. This prevents vibrations or seizures due to zeroing.

On the contrary, when a heavy load such as the rated rolling load is applied, the influence of the minute gaps 26 and 27 is negligible on the barrel portions having peripheral velocity difference due to diameter difference. Therefore, rolling operation can be carried out with no troubles.

This embodiment has the same arrangement as in the third embodiment except as explained above and can attain the same operation and effects as those in the third embodiment.

Figure 21:
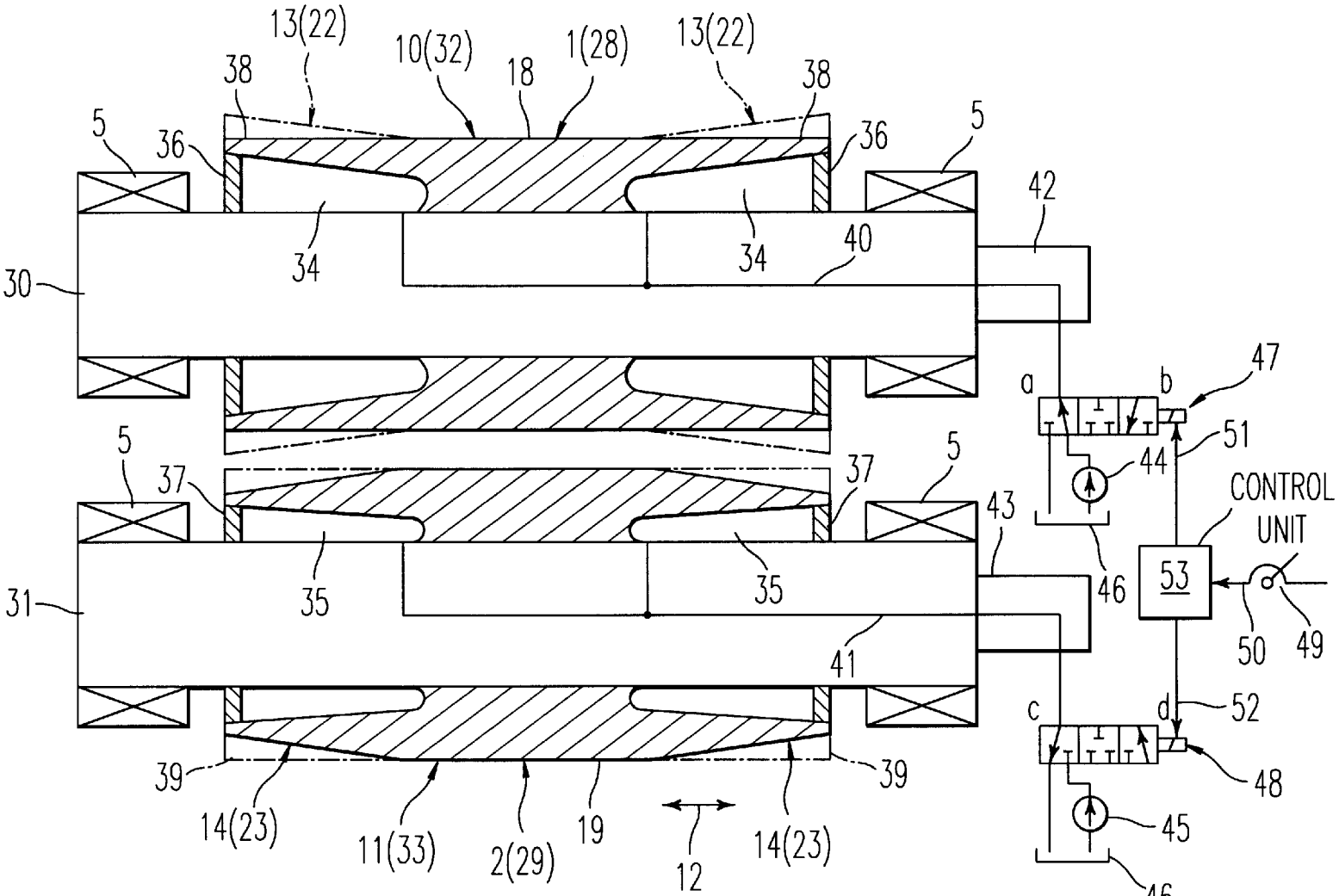
FIG. 21 is a schematic front view in vertical section of a seventh embodiment of the invention.
Figure 22:
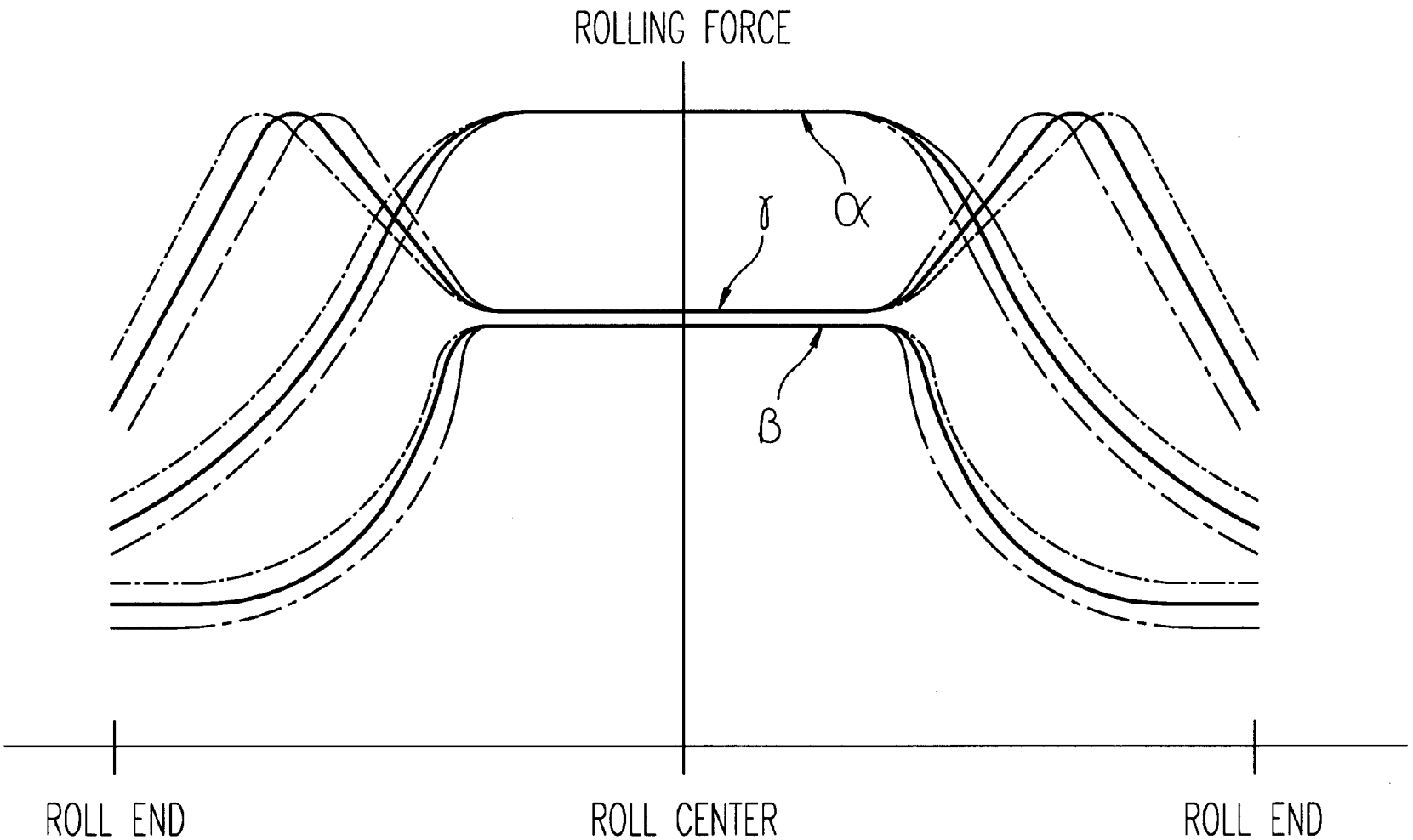
FIG. 22 is a diagram showing the relationship between axial position of roll and rolling force.

FIGS. 21 and 22 represent a seventh embodiment of the present invention.

This embodiment is applied on the different velocity rolling mill of the type shown in FIG. 7. The same components as shown in FIG. 7 are referred to by the same reference numerals and a detailed description of such components is not provided here.

Figure 13:
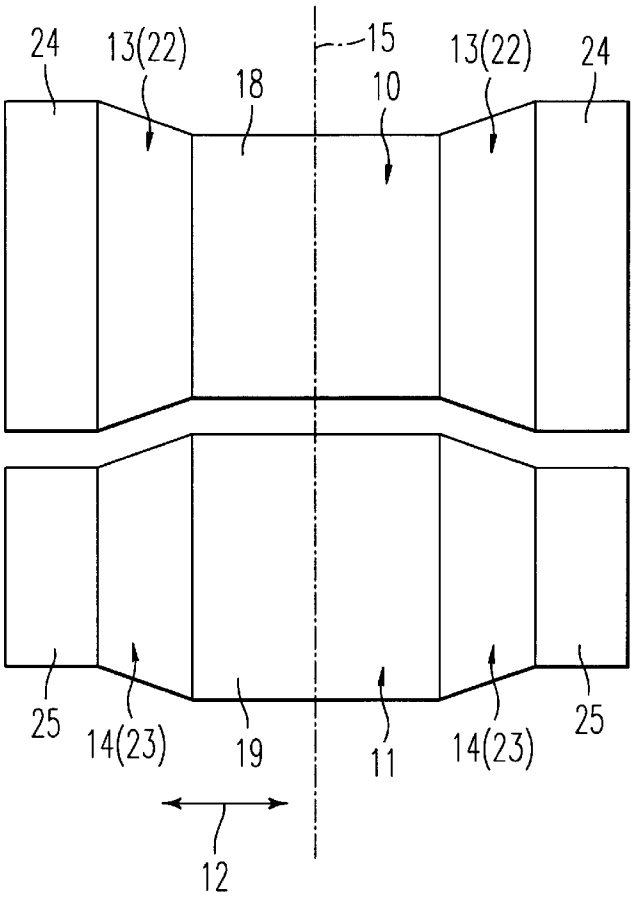
FIG. 13 schematically illustrates a third embodiment of the present invention.

This embodiment may also be applied to the different velocity rolling mill of the type shown in FIG. 13 or any other different velocity rolling mills.

This embodiment resides in that at least one of a pair of rolls 1 and 2 is in the form of a profile variable roll (both being shown in FIG. 21; c.f. parts 28 and 29) with the profile changeable during rolling operation.

As shown in FIG. 21, the profile variable rolls 28 and 29 may be variable crown rolls (so-called VC roll;) which respectively comprise roll sleeves 32 and 33 serving as the barrels 10 and 11 and shrinkage- or cooling-fitted to outer peripheries of roll shafts 30 and 31 supported by roll chocks 5, annular fluid pressure chambers 34 and 35 between the roll shafts 30 and 31 and the roll sleeves 32 and 33. Outer profiles of the fluid pressure chambers 34 and 35 are changed by selectively supplying and discharging fluid in pressure to and from the fluid pressure chambers 34 and 35, respectively.

Reference numerals 36 and 37 represent closing members to close the fluid pressure chambers 34 and 35, respectively.

More specifically, for example in the case of FIG. 21, the fluid pressure chambers 34 and 35 of the profile variable rolls 28 and 29 are provided at positions of varied profile portions 13 and 14 such as the divergent and convergent portions 22 and 23 of the rolls 1 and 2. By selectively supplying and discharging pressure fluid to and from the fluid pressure chambers 34 and 35, the varied profile portions 13 and 14 such as the divergent and convergent portions 22 and 23 may be caused to emerge or outer profiles of the portions 13 and 14 may be changed.

In other words, in the figure, the roll sleeve 32 of the upper roll 1 end with parallel (or divergent or convergent) portions 38 as shown by solid lines when the fluid pressure chamber 34 is not supplied with pressure fluid. When pressure fluid is supplied to the chambers 34, the roll sleeve 32 is increased in diameter at its ends to provide divergent portions 22 as shown by two-dot chain lines.

The roll sleeve 33 of the lower roll 2 end with convergent portions 39 as shown by solid lines when the fluid pressure chamber 35 is not supplied with fluid under pressure. When pressure fluid is supplied to the chambers 35, the roll sleeve 33 is increased in diameter at their ends to provide parallel (or divergent or convergent) portions 39 as shown by two-dot chain lines.

The fluid pressure chambers 34 and 35 of the profile variable rolls 28 and 29 may be provided at positions other than the varied profile portions 13 and 14, i.e. at positions of the parallel portions 18 and 19 so as to change the profiles of the parallel portions 18 and 19. In a case where each of the rolls 1 and 2 have two or more varied profile portions 13 or 14, fluid pressure chambers 34 and 35 of the profile variable rolls 28 and 29 may be provided to some or all of the varied profile portions 13 and 14.

The roll shafts 30 and 31 have fluid passages 40 and 41 for communication of the fluid pressure chambers 34 and 35 with ends of the roll shafts 30 and 31, respectively. Rotary joints 42 and 43 are mounted on such ends of the roll shafts 30 and 31, and changeover valves 47 and 48 are provided to switch to the supply of pressure fluid from pumps 44 and 45 to the fluid pressure chambers 34 and 35 or to the discharge of pressure fluid from the fluid pressure chambers 34 and 35 to a tank 46 via the fluid passages 40 and 41 and the rotary joints 42 and 43, respectively.

A control unit 53 is provided to provide a control such that, based on an input signal 50 from an input unit 49, switching signals 51 and 52 are sent to the changeover valves 47 and 48 to increase diameter of the fluid pressure chambers 34 and 35 of one of the rolls (1, 2) and to reduce diameter of the fluid pressure chambers 35 and 34 of the other roll (2, 1).

With the above arrangement, when the profile control amount to the workpiece 3 is to be changed, an input signal 50 is sent to the control unit 53 by operating the input unit 49, and switching signals 51 and 52 corresponding to the input signal 50 are sent from the control unit 53 to the changeover valves 47 and 48 in order to switch over the valves properly. As a result, fluid under pressure is supplied from the pumps 44 and 45 to the fluid pressure chambers 34 and 35 via the fluid passages 40 and 41 and the rotary joints 42 and 43 or discharged from the fluid pressure chambers 34 and 35 to the tank 46 so that diameter of the fluid pressure chambers 34 or 35 (i.e. the divergent or convergent portions 22 or 23) of one of the rolls (1, 2), and at the same time, diameter is reduced in the fluid pressure chambers 35 or 34 (i.e., the convergent or divergent portions 23 or 22) of the other roll (2, 1).

Figure 8:
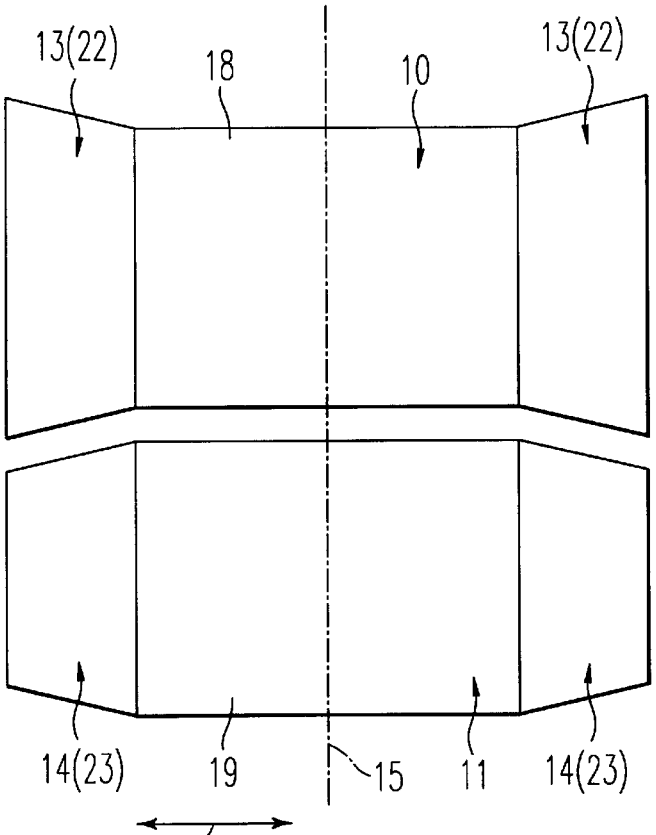
FIG. 8 is an enlarged view of barrels of the rolls shown in FIG. 7.

More specifically, in FIG. 21, when the upper roll 1 in the form of the profile variable roll 28 is set to have the parallel portions 38 as shown by solid line and the lower roll 2 in the form of the profile variable roll 25 is set to have the parallel portions 39 as shown by two-dot chain line, the changeover valves 47 and 48 are changed over to "a" side and "c" side, respectively, by the switching signals 51 and 52 from the control unit 53. In the upper roll 1, pressure fluid is supplied to the fluid pressure chamber 34 from the pump 44 via the rotary joint 42 and the fluid passage 40 to provide the divergent portions 22 as shown by two-dot chain line. At the same time, in the lower roll 2, pressure fluid from the fluid pressure chamber 35 is discharged via the fluid passage 41 and the rotary joint 43 to provide the divergent portions 23 as shown by solid line, so that the rolls 1 and 2 have the same profile as shown in FIGS. 7 and 8. When the rolls 1 and 2 have the same profile as shown in FIGS. 7 and 8, the changeover valves 47 and 48 are changed to a neutral position to stop supply and discharge of the pressure fluid.

Laterally different velocity rolling under this condition will make the workpiece 3 rolled with its profile being controlled in the same manner as in FIGS. 7 and 8.

When profile control amount to the workpiece 3 is to be changed during rolling operation, an input signal 50 is sent to the control unit 53 by operating the input unit 49, and the changeover valves 47 and 48 are temporarily changed over to "b" side and "d" side by the switching signals 51 and 52 from the control unit 53.

Then, in the upper roll 1, pressure fluid from the fluid pressure chamber 34 is discharged via the fluid passage 40 and the rotary joint 42 to the tank 46, and the divergent portions 22 shown by two-dot chain lines is slightly decreased. At the same time, in the lower roll 2, pressure fluid from the pump 46 is supplied to the fluid pressure chamber 35 via the rotary joint 43 and the fluid passage 41, and diameter of the convergent portions 23 shown by solid line are slightly increased. When the divergent portions 22 are reduced in diameter to a desired extent and the convergent portions 23 are increased in diameter to a desired extent, the changeover valves 47 and 48 are changed to neutral position to stop supply and discharge of the pressure fluid.

In this manner, while the conditions are kept such that the barrels 10 and 11 are bilaterally symmetrical with respect to the roll center 15 and sum of roll diameters of the barrels 10 and 11 is substantially constant, the divergent and convergent portions 22 and 23 are changed in profile during rolling operation to change the different velocity rate of and thus the rolling force of the portions 22 and 23 so that the profile control amount to the workpiece 3 can be changed.

When the profile control amount to the workpiece 3 is to be changed by controlling the rotational velocity ratio of the rolls 1 and 2, different velocity ratio of the whole rolls 1 and 2 including the central parallel portions 18 and 19 is changed, and the rolling force is extensively changed. Therefore, adjustment of the roll gap 4 is required, which causes difficulty. However, in this embodiment, the profile variable rolls 28 and 29 are used to partially change the different velocity ratio, which contributes to controlling the change of the rolling force as a whole to lower value. Therefore, adjustment of the roll gap 4 is not required and profile control amount can be readily changed.

In the above arrangement, even when a roll with its profile not changeable is used as one of the rolls 1 and 2 and the profile variable roll 28 or 29 is used as the other roll, substantially the same effects can be obtained.

The profile control amount may also be readily changed by providing the fluid pressure chambers 34 and 35 of the profile variable rolls 28 and 29 at positions other than the varied profile portions 13 and 14, i.e., at the parallel portions 18 and 19 and changing the profiles of the parallel portions 18 and 19 during rolling operation.

In a situation where each of the rolls 1 and 2 comprises two or more varied profile portions 13 or 14, the profile control amount may also be readily changed by providing the fluid pressure chambers 34 and 35 of the profile variable rolls 28 and 29 to some or all of the varied profile portions 13 and 14 and partially changing the profiles.

In conventional rolling mills using profile variable rolls, diameters of the paired rolls 28 and 29 are increased at the same time or decreased at the same time. When this were applied to the present invention, the effect of the laterally different velocity rolling would be lost. In the present invention, when one of the profile variable rolls 28 and 29 is increased in diameter, the other of the profile variable rolls 29 or 28 must be decreased in diameter. Particularly, it is recommendable to automatically perform this by use of the control unit 53.

The laterally different velocity rolling mill according to the invention is more effective when it is used for the so-called temper rolling or skin pass rolling. In the temper rolling, cold rolling with reduction of about 0.5–4% is performed on a workpiece 3, which has been annealed after cold rolling, in order to prevent coil break or stretcher strain, to give required mechanical properties, to improve the profile into flatness and to finish the product with proper surface roughness suitable for usage.

FIG. 22 is a diagram which shows the above more concretely. Positions on the rolls 1 and 2 are plotted on the abscissa, and rolling force is plotted on the ordinate, with the rotational velocity ratio of the rolls 1 and 2 being changed.

In this diagram, the line $\alpha$ shows pressure distribution in a case where a rotational velocity of the parallel portion 18 of the upper roll 1 is equal that of the parallel portion 19 of the lower roll 2, i.e., in a case where the rotational velocity ratio of the rolls 1 and 2 is 1.0. The line $\beta$ represents pressure distribution in a case where the rotational velocity of the parallel portion 18 of the upper roll 1 is increased to a value slightly higher than a rotational velocity of the parallel portion 19 of the lower roll 2, e.g., in a case where the rotational velocity ratio is 1.2. The line $\gamma$ represents pressure distribution in a case where the rotational velocity of the parallel portion 18 of the upper roll 1 is decreased to a value slightly lower than that of the parallel portion 19 of the lower roll 2, e.g., in a case where the rotational velocity ratio is 0.8.

In any of the lines $\alpha$ to $\gamma$, solid lines represent rolling force distribution when rolling is performed with the divergent and convergent portions 22 and 23 of the rolls 1 and 2 being set to predetermined standard profiles. One-dot chain lines show changes when the divergent and convergent portions 22 are respectively increased and decreased in diameter in comparison with the standard profiles during rolling operation. Two-dot chain lines show change when the divergent and convergent portions 22 and 23 are respectively decreased and increased in diameter in comparison with the standard profiles during rolling operation.

According to FIG. 22, on the lines $\alpha$ where the rotational velocity ratio of the rolls 1 and 2 is 1.0, the rolling force is at the highest on the parallel portions 18 and 19 rotated at equal velocity as shown by solid line, and is decreased toward the opposite ends of the divergent and convergent portions 22 and 23 since the peripheral velocity difference is increased toward the opposite ends of the portions 22 and 23. When the divergent portions 22 of the roll 1 are increased in diameter to profiles greater than the standard profiles and the convergent portions 23 of the rolls 2 are decreased in diameter to profiles smaller than the standard profiles, the rolling force at the opposite ends is decreased as shown by one-dot chain lines since the peripheral velocity difference between the divergent and convergent portions 22 and 23 is increased more than the case shown by the solid line. On the contrary, when the divergent portions 22 are decreased in diameter to profiles smaller than the standard profiles and the convergent portions 23 are increased in diameter to profiles greater than the standard profiles, the rolling force at the opposite ends is increased as shown by two-dot chain lines since the peripheral velocity different between the divergent and convergent portions 22 and 23 is decreased more than the case shown by the solid line. Therefore, the profile control amount can be adjusted by changing the profiles of the rolls 1 and 2.

In the lines $\beta$ where the rotational velocity ratio of the rolls 1 and 2 is 1.2, the rolling force is generally decreased in comparison with the case of the lines $\alpha$. When the divergent portions 22 are increased in diameter to profiles greater than the standard profiles and the convergent portions 23 are decreased in diameter to profiles smaller than the standard profiles, the rolling force at the opposite ends is decreased as shown by one-dot chain lines since peripheral velocity difference between the divergent and convergent portions 22 and 23 is increased in comparison with the case shown by solid line. On the contrary, when the divergent portions 22 are decreased in diameter to profiles smaller than the standard profiles and the convergent portions 23 are increased in diameter to profiles greater than the standard profiles, the rolling force at the opposite ends is increased as shown by two-dot chain lines since peripheral velocity difference between the divergent and convergent portions 22 and 23 is decreased in comparison with the case shown by the solid line. Therefore, the profile control amount can be adjusted by changing the profiles of the rolls 1 and 2.

Further, in the lines γ where the rotational velocity ratio of the rolls 1 and 2 is 0.8, as shown by solid line, the rolling force is the lowest on the parallel portions 18 and 19 having peripheral velocity difference; and toward the opposite ends of the divergent and convergent portions 22 and 23, the rolling force is first increased and then is decreased sine peripheral velocity difference toward the opposite ends is firstly decreased, becomes zero and then is increased. When the divergent portions 22 are increased in diameter to profiles greater than the standard profiles and the convergent portions 23 are decreased in diameter to profiles smaller than the standard profiles, the rolling force at the opposite ends is decreased as shown by one-dot chain lines since peripheral velocity difference between the divergent and convergent portions 22 and 23 is decreased in comparison with the case shown by the solid line. On the contrary when the divergent portions 22 are decreased in diameter to profiles smaller than the standard profiles during rolling operation and the convergent portions 23 are increased in diameter to profiles greater than the standard profiles, the rolling force at the opposite ends is increased as shown by two-dot chain lines since peripheral velocity difference between the divergent and convergent portions 22 and 23 is increased in comparison with the case shown by the solid line. Therefore, it is evident that the profile control amount can be adjusted by changing profiles of the rolls 1 and 2.

Figure 23:
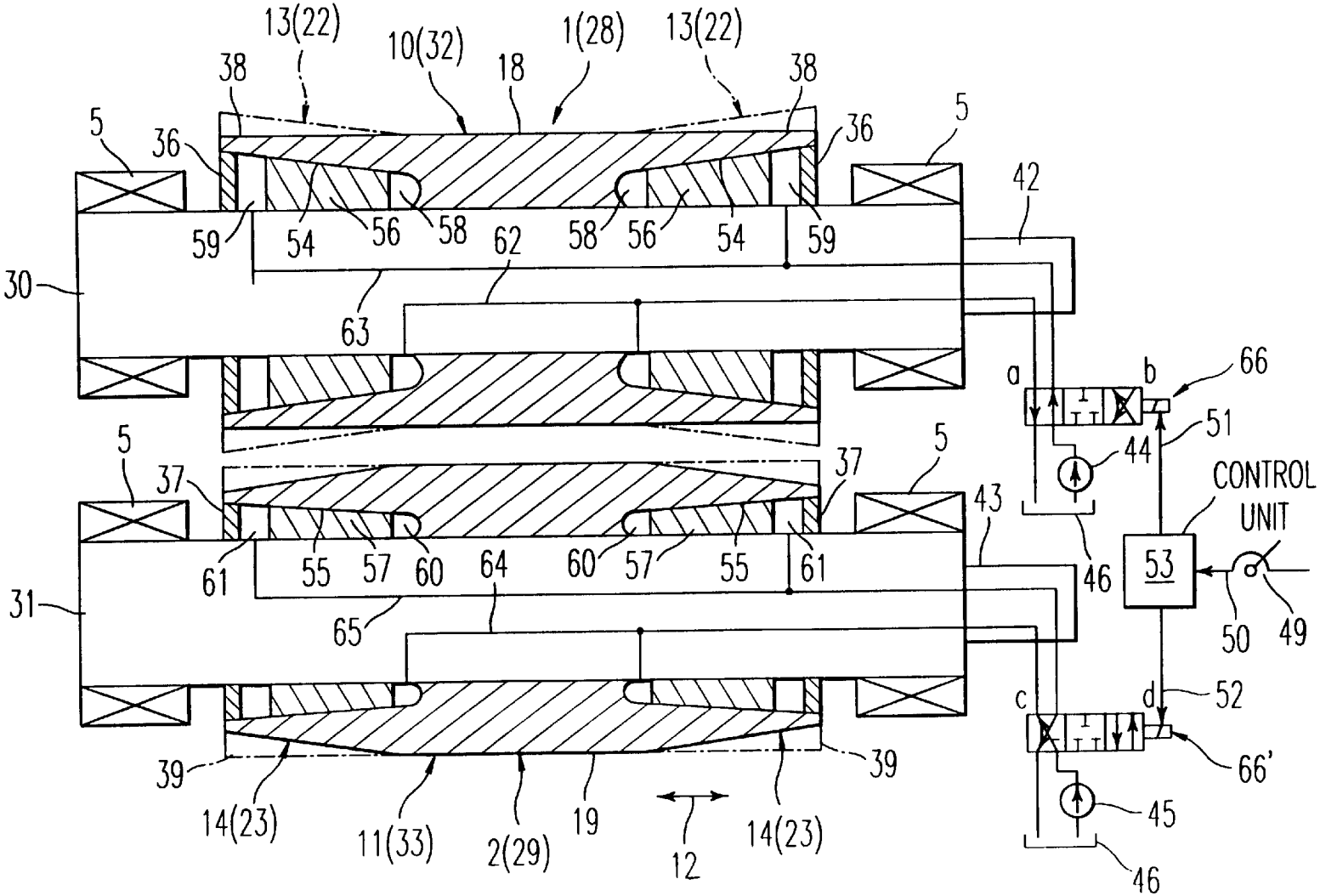
FIG. 23 is a schematic front view in vertical section of an eighth embodiment of the invention.
Figure 28:
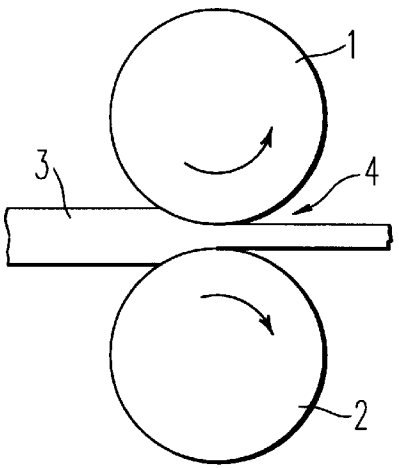
FIG. 28 PRIOR ART
FIG. 28 is a side view of a conventional different velocity rolling mill.

FIG. 23 represents an eighth embodiment of the invention in which profile variable rolls 28 and 29 are provided such that tapered annular pistons 56 and 57 are placed in tapered annular spaces 54 and 55 defined between roll shafts 30 and 31 and roll sleeves 32 and 33, respectively. Pressurized fluid is selectively supplied and discharged to and from fluid pressure chambers 58–61 on opposite sides of the pistons 56 and 57 via fluid passages 62–65 and changeover valves 66 and 66'. As a result, the tapered pistons 56 and 57 are moved, and by placing them or withdrawing them from the tapered spaces 54 and 55, profiles of the rolls 1 and 2 can be changed. Thus, tapered piston rolls 28 and 29 are used instead of the profile variable rolls 28 and 29.

Also with the above arrangement, the profile control amount to the workpiece 3 can be changed by changing the profiles of the rolls 1 and 2 during rolling operation as in the embodiments described above.

This embodiment has the same arrangement as the above embodiments except the above points, and the same operation and the same effects can be provided.

FIGS. 24 and 25 represent a ninth embodiment of the present invention. In this embodiment, three or more rolls 67 to 70 are combined together (in vertical direction in the figure, though the rolls may be arranged not only in vertical direction but also in horizontal direction, in inclined direction or in zigzag manner) to provide a plurality of rolling passes 71–73.

Pairs of the rolls 67 to 70 adjacent to each other to provide the rolling passes 71 to 73 have barrels each of which is bilaterally symmetrical with respect to the roll center 15, the sum of roll diameters of the paired barrels being substantially constant. Under these conditions, one of the pair of barrels has varied profile portions 74–76 such as divergent or convergent portions and the other of the paired barrels have varied profile portions 75–77 such as divergent or convergent portions at positions corresponding to the above-mentioned divergent or convergent portions of the one of the paired barrels.

More specifically, for example in FIG. 25, a parallel portion 78 having uniform diameter is formed at the center of the barrel of the roll 67 at the lowest position, ad divergent portions with diameter increasing toward the ends are formed on each end of the barrel as a varied profile portion 74. At the center of the barrel of a roll 68, which makes a pair with the roll 67, a parallel portion 79 having a diameter smaller than that of the parallel portion 78 is formed, and convergent portions having diameter a decreasing toward the ends are formed on opposite ends of the barrel as varied profile portions 75. It is designed such that sum of the diameters of the divergent and convergent portions which constitute the varied profile portions 74 and 75 is substantially equal to sum of the diameters of the parallel portions 78 and 79.

At the center of a barrel of a roll 69, which makes a pair with the roll 68, a parallel portion 80 having the same diameter as that of the parallel portion 79 is formed, and divergent portions having a diameter increasing toward the ends are formed on opposite ends of the barrel as varied profile portions 76. It is designed such that sum of diameters of the divergent and convergent portions which constitute the varied profile portions 75 and 76 is substantially equal to sum of diameters of the parallel portions 79 and 80.

Further, at the center of a barrel of a roll 70, which makes a pair with the roll 69 and which is at the highest position, a parallel portion 81 having a diameter larger than that of the parallel portion 80 is formed, and divergent portions having a diameter decreasing toward the ends are formed on opposite ends of the barrel as varied profile portions 77. It is designed such that sum of diameters of the divergent and convergent portions which constitute the varied profile portions 76 and 77 is substantially equal to sum of diameters of the parallel portions 80 and 81.

In the figure, reference numerals 82 and 83 represent tension adjusters between the rolling passes 71–73.

In this embodiment, the workpiece 3 is passed through the rolling pass 71 formed by the rolls 67 and 68, through the rolling pass 72 formed by the rolls 68 and 69, and through the rolling pass 73 formed by the rolls 69 and 70 in this order from an upstream side thereof, and laterally different velocity rolling is performed a plurality of times.

As described above, multi-pass rolling is performed on a single rolling mill, which makes it possible to decrease the effect of laterally different velocity rolling per each of the rolling passes 71–73. As a result, the degree of the profile change of the varied profile portions 74–77 can be decreased (i.e., the tapered shape can be decreased). This makes it possible to prevent streaking, bending, etc. of the workpiece 3 at the boundaries between the varied profile portions 74–77 and the parallel portions 78–81.

Because the number of the rolling passes 71–73 is increased, even when the degree of profile change of the varied profile portions 74–77 on each of the rolling passes 71–73 is decreased, a better effect of laterally different velocity rolling can be obtained in comparison with a single pass rolling on a single rolling mill as a whole, and higher rolling reduction can be achieved without any unreasonable problems.

Figure 27:
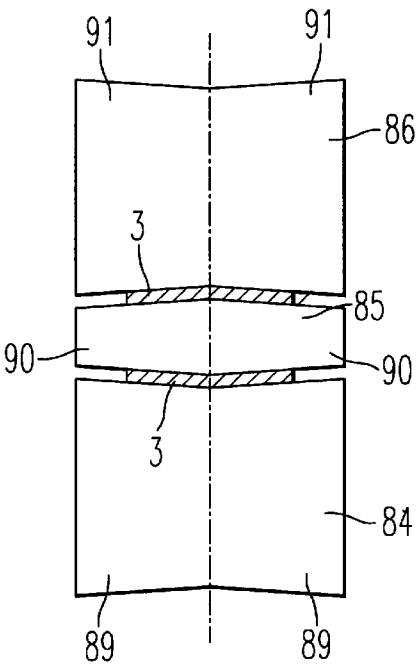
FIG. 27 is a front view of the embodiment shown in FIG. 26.
Figure 26:
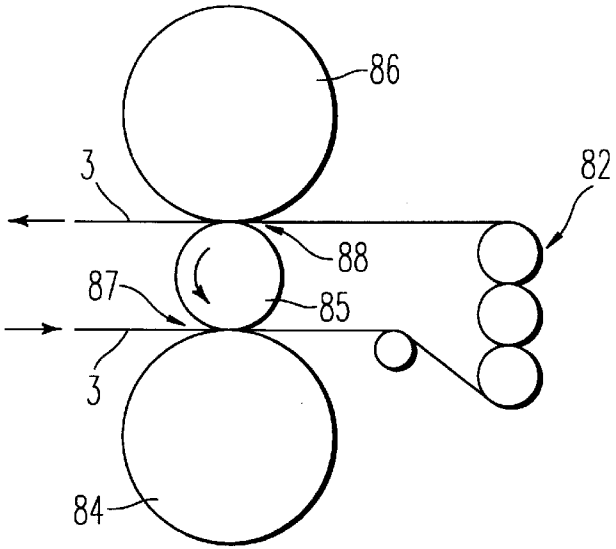
FIG. 26 is a schematic side view of a tenth embodiment of the invention.

FIGS. 26 and 27 represent a tenth embodiment of the present invention. Three rolls 84 to 86 are combined together to form two rolling passes 87 and 88.

The rolls 84–86 have no parallel portions and comprise only varied profile portions 89–91.

This embodiment has the same arrangement as the above embodiments, and the same operation and the same effects can be provided.

The rolling mill with laterally different velocities according to the present invention is not limited to the above embodiments. Basically, it is desirable that it is used for the purpose of reducing occurrence of edge drop or crown, while it is needless to say that it may be used mainly for the purpose of achieving profile control of the workpiece, that the roll may have any profile as long as the requirements for laterally different velocity rolling are satisfied, that any combination other than the above embodiments is also achievable, and further, that modifications and changes can be made without departing from the spirit and the scope of the present invention.

According to the rolling mill with laterally different velocities as described above, the following superb effects can be attained:

(1) Rolling force applied on a workpiece is in uneven distribution axially of the rolls, and the distribution pattern can be easily adjusted during rolling operation by changing the rotational velocity ratio of the rolls, and it is possible to provide distribution pattern of rolling force suitable to prevent edge drop and crown. Moreover, by changing the rotational velocity ratio of the rolls to any value other than 1.0, the effect of decreasing the rolling force by normal different velocity rolling in enhanced to reduce the level of the rolling force necessary for the rolling operation as a whole. Compared with conventional different velocity rolling mill, the occurrence of edge drop and crown can be extensively reduced.

(2) It is possible to change profile control amount of the workpiece without controlling the rotational velocity ratio of the rolls and without adjusting the roll gap.

(3) Rolling operation can be carried out without causing streaking, bending etc. of the workpiece, and a superb effect of achieving extensive rolling reduction can be obtained. Obviously, numerous modifications and variations of the present invention are possible in light of the above teachings. It is therefore to be understood that within the scope of the appended claims, the invention may be practiced otherwise than as specifically described herein.

What is claimed is:

1. A rolling mill with laterally different velocities which comprises:

first and second work rolls, a sum of the diameters thereof being substantially constant along the length thereof, each of the work rolls having a parallel portion with a substantially constant diameter in a center portion of a length of the work rolls, the first work roll having divergent portions contiguous with the parallel portion thereof and with the diameter thereof being gradually increased toward end portions thereof, the second work roll having convergent portions contiguous with the parallel portion thereof and with the diameter thereof being gradually decreased toward end portions thereof, and a backup roll provided for each of said work rolls so as to support the work rolls at the parallel portion wherein a rotational velocity ratio of the work rolls is variable.

2. A rolling mill according to claim 1, wherein each of the divergent and convergent portions end, at the end portions of the first work roll, with a further parallel portion having a substantially constant diameter.

3. A rolling mill according to claim 1, wherein said backup roll for each of said support rollers support the work rolls exclusively at said parallel portion of said work rolls.

4. A rolling mill according to claim 1 or 2, wherein a plurality of minute gaps, gradually enlarged toward the end portions of the rolls, are formed between the divergent and convergent portions such that said portions are not mutually contacted when a light load is applied to the rolls and are mutually contacted when a rolling load is applied to the rolls.

5. A rolling mill according to claim 1 or 2, wherein at least one of the work rolls comprises a variable profile roll with a partially variable contour of the divergent or convergent portions thereof, the variable profile roll comprising a variable crown roll with inner pressure chambers to and from which a pressurized fluid is selectively supplied and discharged.

6. A rolling mill according to claim 1 or 2, wherein at least one of the work rolls comprises a variable profile roll with a partially variable contour of the divergent or convergent portions thereof, the profile variable roll comprising a tapered piston roll with tapered pistons movably arranged therein.

7. A rolling mill according to claim 4, wherein at least one of the work rolls comprises a variable profile roll with a partially variable contour in the divergent or convergent portions thereof, the variable profile roll comprising a variable crown roll with inner pressure chambers to and from which a pressurized fluid is selectively supplied and discharged.

8. A rolling mill according to claims 4, wherein at least one of the work rolls comprises a variable profile roll with a partially variable contour of the divergent or convergent portions thereof, the profile variable roll comprising a tapered piston roll with tapered pistons movably positioned therein.

9. A rolling mill according to claim 5, further comprising a control unit such that upon a diameter of the divergent or convergent portions of one of the work rolls being partially increased, a diameter of a matching portion of the other work roll is decreased.

10. A rolling mill according to claim 6, further comprising a control unit such that upon a diameter of the divergent or convergent portions of one of the work rolls being partially increased, a diameter of a matching portion of the other work roll is decreased.

11. A rolling mill according to claim 7, further comprising a control unit such that upon a diameter of the divergent or convergent portions of one of the work rolls being partially increased, a diameter of a matching portion of the other work roll is decreased.

12. A rolling mill according to claim 8, further comprising a control unit such that upon a diameter of the divergent or convergent portions of one of the work rolls being partially increased, a diameter of a matching portions of the other work roll is decreased.

13. A rolling mill with laterally different velocities comprising, at least three work rolls combined together to provide a plurality of rolling passes, a sum of the diameters of the work rolls being substantially constant along their length, each of the work rolls having a parallel portion with a substantially constant diameter in a center portion of a length of the rolls, wherein divergent and convergent portions contiguous with parallel portions of the rolls and with diameters gradually increased and decreased toward the roll ends, respectively, are alternately formed on adjacent rolls.

* * * * *

UNITED STATES PATENT AND TRADEMARK OFFICE

CERTIFICATE OF CORRECTION

PATENT NO. : 6,065,319
DATED : May 23, 2000
INVENTOR(S) : Masao Mikami, et al.

It is certified that error appears in the above-identified patent and that said Letters Patent is hereby corrected as shown below:

Column 1,
Line 38, delete "as" and insert -- has --.
Line 65, delete "and" and insert -- or --.

Column 3,
Line 41, after "and" insert -- a --.

Column 5,
Line 39, delete "or" and insert -- on --.

Column 7,
Line 2, delete "on" and insert -- or --.

Column 9,
Line 13, delete "distribution" and insert -- distributions --.

UNITED STATES PATENT AND TRADEMARK OFFICE

CERTIFICATE OF CORRECTION

PATENT NO. : 6,065,319
DATED : May 23, 2000
INVENTOR(S) : Masao Mikami, et al.

It is certified that error appears in the above-identified patent and that said Letters Patent is hereby corrected as shown below:

Column 11,
Line 37, delete "in" and insert -- under --.
Line 62, delete "pressure fluid' and insert -- fluid under pressure --.

Column 16,
Line 9, delete "ad" and insert -- and --.

Signed and Sealed this

Seventh Day of August, 2001

Nicholas P. Godici

*Attest:*

*Attesting Officer*

NICHOLAS P. GODICI
*Acting Director of the United States Patent and Trademark Office*